US007561817B2

(12) United States Patent
Sato

(10) Patent No.: US 7,561,817 B2
(45) Date of Patent: Jul. 14, 2009

(54) TONER CARTRIDGES, DEVELOPMENT CARTRIDGES, AND IMAGE FORMING APPARATUS INCLUDING SUCH CARTRIDGES

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 356 days.

(21) Appl. No.: 11/363,163

(22) Filed: Feb. 28, 2006

(65) Prior Publication Data

US 2006/0193652 A1 Aug. 31, 2006

(30) Foreign Application Priority Data

Feb. 28, 2005 (JP) ..... 2005-053069

(51) Int. Cl.
*G03G 15/00* (2006.01)
*G03G 15/08* (2006.01)

(52) U.S. Cl. ..... 399/90; 399/119

(58) Field of Classification Search ..... 399/90, 399/119, 262
See application file for complete search history.

(56) References Cited

U.S. PATENT DOCUMENTS 4,839,691 A * 6/1989 Tagawa et al. ..... 399/119
5,523,832 A 6/1996 Hamamichi et al.
5,541,714 A 7/1996 Watanabe et al.
5,608,501 A 3/1997 Makino
5,742,882 A 4/1998 Lee
5,867,756 A 2/1999 Suzuki et al.
6,127,083 A 10/2000 Nomura et al.
6,169,865 B1 1/2001 Miyabe et al.
6,351,618 B1 2/2002 Pollocks, Jr.
6,501,933 B2 12/2002 Ishii
6,823,155 B2 11/2004 Tsuda et al.
7,252,918 B2 8/2007 Nakamura et al.
7,272,336 B1 * 9/2007 Dawson et al. ..... 399/90
7,321,739 B1 * 1/2008 Dawson et al. ..... 399/90
2001/0041079 A1 11/2001 Michlin et al.

(Continued)

FOREIGN PATENT DOCUMENTS

CN 1167280 A 12/1997

(Continued)

OTHER PUBLICATIONS

European Patent Office, Extended European Search Report for European Patent Application No. 06003853.6-1240, dated Jan. 18, 2008.

(Continued)

*Primary Examiner*—William J Royer
(74) *Attorney, Agent, or Firm*—Baker Botts L.L.P.

(57) ABSTRACT

An image forming apparatus includes: an electrostatic latent image bearing member; a toner cartridge; a developing member; a transfer member; a development cartridge; a development contact; and electrical connection units. The toner cartridge is removably coupled to the development cartridge. The development cartridge incorporates at least the developing member. The development contact is provided on the toner cartridge and is configured to receive a voltage to be applied to the developing member. The electrical connection units are provided on the toner cartridge and the development cartridge, respectively, and apply the voltage from the development contact to the developing member when the toner cartridge and the development cartridge are coupled to each other.

27 Claims, 17 Drawing Sheets

U.S. PATENT DOCUMENTS

| | | | |
|---|---|---|---|
| 2003/0156848 | A1 | 8/2003 | Kawai et al. |
| 2004/0131382 | A1 | 7/2004 | Kikuchi et al. |
| 2006/0177241 | A1 | 8/2006 | Sato et al. |
| 2006/0193658 | A1 | 8/2006 | Sato |

FOREIGN PATENT DOCUMENTS

| | | | |
|---|---|---|---|
| CN | 1201533 | A | 12/1998 |
| DE | 4223147 | A1 | 1/1993 |
| EP | 0670530 | A2 | 9/1995 |
| EP | 0770931 | A2 | 5/1997 |
| JP | H01-193877 | A | 8/1989 |
| JP | H03-180875 | A | 8/1991 |
| JP | H03-204667 | A | 9/1991 |
| JP | H04-031884 | A | 2/1992 |
| JP | H06-019306 | A | 1/1994 |
| JP | H06-102765 | A | 4/1994 |
| JP | H06-222668 | A | 8/1994 |
| JP | H07-113805 | B2 | 12/1995 |
| JP | H09-090733 | A | 4/1997 |
| JP | H09-211948 | A | 8/1997 |
| JP | H09-222796 | A | 8/1997 |
| JP | H09-319201 | A | 12/1997 |
| JP | H09-319214 | A | 12/1997 |
| JP | H10-274881 | A | 10/1998 |
| JP | H11-133711 | A | 5/1999 |
| JP | H11-218957 | A | 8/1999 |
| JP | 11305629 | | 11/1999 |
| JP | 11327288 | | 11/1999 |
| JP | 3044997 | | 3/2000 |
| JP | 2000-098727 | A | 4/2000 |
| JP | 2000-122423 | A | 4/2000 |
| JP | 2000-187382 | A | 7/2000 |
| JP | 2000-187431 | A | 7/2000 |
| JP | 2000-267420 | A | 9/2000 |
| JP | 2001-092256 | A | 4/2001 |
| JP | 2002-040783 | A | 2/2002 |
| JP | 2002-156891 | A | 5/2002 |
| JP | 2002169365 | | 6/2002 |
| JP | 2002-244533 | A | 8/2002 |
| JP | 2002-258693 | A | 9/2002 |
| JP | 2002287473 | | 10/2002 |
| JP | 2003-186369 | A | 7/2003 |
| JP | 2004-012652 | A | 1/2004 |
| JP | 3595798 | | 9/2004 |

OTHER PUBLICATIONS

European Patent Office, European Search Report for Europeon Patent Application No. 06003846.0 (counterpart to the corresponding US Patent Application Publication No. 20060193658 A1). dated Nov. 22, 2007.

Patent Office of The People's Republic of China, First Office Action for Chinese Patent Application No. 200610055016.8 (counterpart to the corresponding US Patent Application Publication No. 20060193658 A1), mailed Apr. 25, 2008.

Japanese Patent Office, Office Action for Japanese Patent Application No. 2005-053070 (counterpart to the corresponding US Patent Application Publication No. 20060193658 A1), mailed May 27, 2008.

Patent Office of The People's Republic of China, First Office Action for Chinese Patent Application No. 2006100550153 (counterpart to the corresponding US Patent Application Publication No. 20060177241 A1), mailed Jun. 27, 2008.

Japanese Patent Office, Office Action for Japanese Patent Application No. 2005-053796 (counterpart to the corresponding US Patent Application Publication No. 20060177241 A1), mailed May 27, 2008.

Japanese Patent Office, Office Action for Japanese Patent Application No. 2005-208443 (counterpart to the corresponding US Patent Application Publication No. 20060177241 A1), mailed Oct. 14, 2008.

* cited by examiner

TONER CARTRIDGES, DEVELOPMENT CARTRIDGES, AND IMAGE FORMING APPARATUS INCLUDING SUCH CARTRIDGES

CROSS REFERENCE TO RELATED APPLICATION

This application claims priority from Japanese Patent Application No. 2005-53069 filed Feb. 28, 2005, the entire content of which is hereby incorporated by reference.

TECHNICAL FIELD

The disclosure relates to an image forming apparatus of an electronic photographic type, in which an electrostatic latent image formed on an electrostatic latent image bearing body is developed into a toner image, and the toner image is transferred to a recording medium, and to a toner cartridge and a development cartridge that can be used in the image forming apparatus.

BACKGROUND

There has been proposed an image forming apparatus of a type that includes: an electrostatic latent image bearing body such as a photosensitive body having a surface, on which an electrostatic latent image is formed; a toner cartridge containing toner; a developing member such as a developing roller for supplying toner from the toner cartridge to the surface of the electrostatic latent image bearing body, thereby developing the electrostatic latent image into a toner image; and a transfer member such as a transfer roller for transferring the toner image from the surface of the electrostatic latent image bearing body to a recording medium. In the image forming apparatus of this type, after an electrostatic latent image is formed on the surface of the electrostatic latent image bearing body, the developing member supplies the toner from the toner cartridge onto the surface of the electrostatic latent image bearing body, thereby developing the latent image. Then, the transfer member transfers the toner image from the surface of the electrostatic latent image bearing body to a recording medium. As a result, an image corresponding to the electrostatic latent image is formed on the recording medium.

In the image forming apparatus of this type, a bias voltage has to be applied to various components, such as the developing roller, the transfer roller, and a charger. The charger is for applying an electric charge uniformly to the photosensitive body.

Japanese Unexamined Patent Application Publication No. 11-327288 proposes applying, from the main body of the image forming apparatus, bias voltages to a cartridge, in which the photosensitive body, the developing roller and the transfer roller are mounted.

Japanese Unexamined Patent Application Publication No. 11-305629 proposes providing an electrode on one end of a cartridge that installs a developing roller therein, and providing another electrode in the main body of the image forming apparatus. These electrodes are brought into abutment contact with each other when the cartridge is set in the main body.

SUMMARY

It is assumed that a first electrode for applying a bias voltage to the charger is located near the electrostatic latent image bearing body and that a second electrode for applying a bias voltage to the developing member is provided near to the first electrode. In such a case, however, leakage will possibly occur between the first and second electrodes. This problem is severe especially when the image forming apparatus is made compact.

In view of the foregoing, an object of the invention is to provide an image forming apparatus, a toner cartridge, and a development cartridge that can reliably prevent leakage.

In order to attain the above and other objects, the invention provides an image forming apparatus, including: an electrostatic latent image bearing member; a toner cartridge; a developing member; a transfer member; a development cartridge; a development contact; and electrical connection units. The electrostatic latent image bearing member has a surface on which an electrostatic latent image is formed. The toner cartridge contains toner. The developing member supplies the toner from the toner cartridge onto the surface of the electrostatic latent image bearing member, thereby developing the electrostatic latent image into a toner image. The transfer member transfers the toner image from the surface of the electrostatic latent image bearing member to a recording medium. The toner cartridge is removably coupled to the development cartridge. The development cartridge incorporates at least the developing member. The development contact is provided on the toner cartridge and is configured to receive a voltage to be applied to the developing member. The electrical connection units are provided on the toner cartridge and the development cartridge, respectively, and apply the voltage from the development contact to the developing member when the toner cartridge and the development cartridge are coupled to each other.

According to another aspect, the invention provides a toner cartridge which is removably attachable to a development cartridge that includes a developing member, the toner cartridge including: a casing defining a toner containing portion containing a toner therein; and a development contact which is provided on the casing and which is configured to be electrically connectable with the developing member of the development cartridge.

According to another aspect, the invention provides a development cartridge including: a toner-cartridge-holding portion that removably holds a toner cartridge that contains toner therein; a developing member that supplies toner from the toner cartridge to a surface of an electrostatic latent image bearing member, on which an electrostatic latent image is formed, thereby developing the electrostatic latent image into a toner image; and an electrical connection unit which is provided on the toner-cartridge-holding portion. The electrical connection unit is electrically connected to the toner cartridge to apply a voltage to the developing member when the toner cartridge is mounted in the toner-cartridge-holding portion.

BRIEF DESCRIPTION OF THE DRAWINGS

Illustrative aspects in accordance with the invention will be described in detail with reference to the following figures wherein.

DETAILED DESCRIPTION

Figure 1:
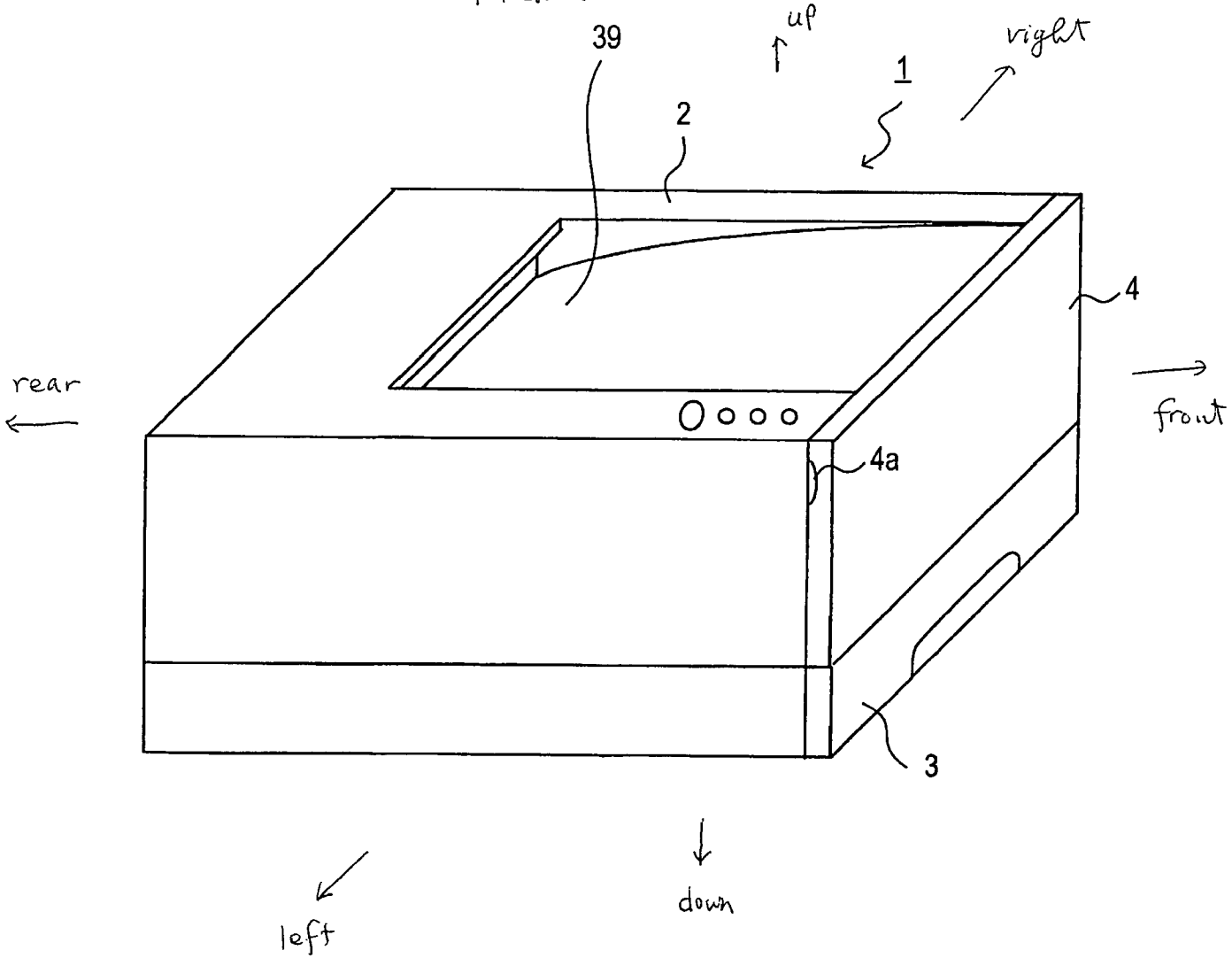
FIG. 1 is a perspective view of a laser printer according to an illustrative aspect of the invention.

An image forming apparatus according to some aspects of the invention will be described while referring to the accompanying drawings wherein like parts and components are designated by the same reference numerals to avoid duplicating description.

FIG. 1 is a perspective view representing the outer appearance of a laser printer 1 according to this aspect.

The terms "upward", "downward", "upper", "lower", "above", "below", "beneath", "left", "right" and the like will be used throughout the description assuming that the laser printer 1 is disposed in an orientation in which it is intended to be used. In use, the laser printer 1 is disposed as shown in FIG. 1. The left-and-right direction defined in the laser printer 1 is equivalent to the widthwise direction of a sheet of paper that is conveyed in the laser printer 1.

As shown in FIG. 1, a cover 2 is provided covering the outer periphery of the main body of the laser printer 1. A sheet cassette 3 is mounted below the cover 2.

Figure 2:
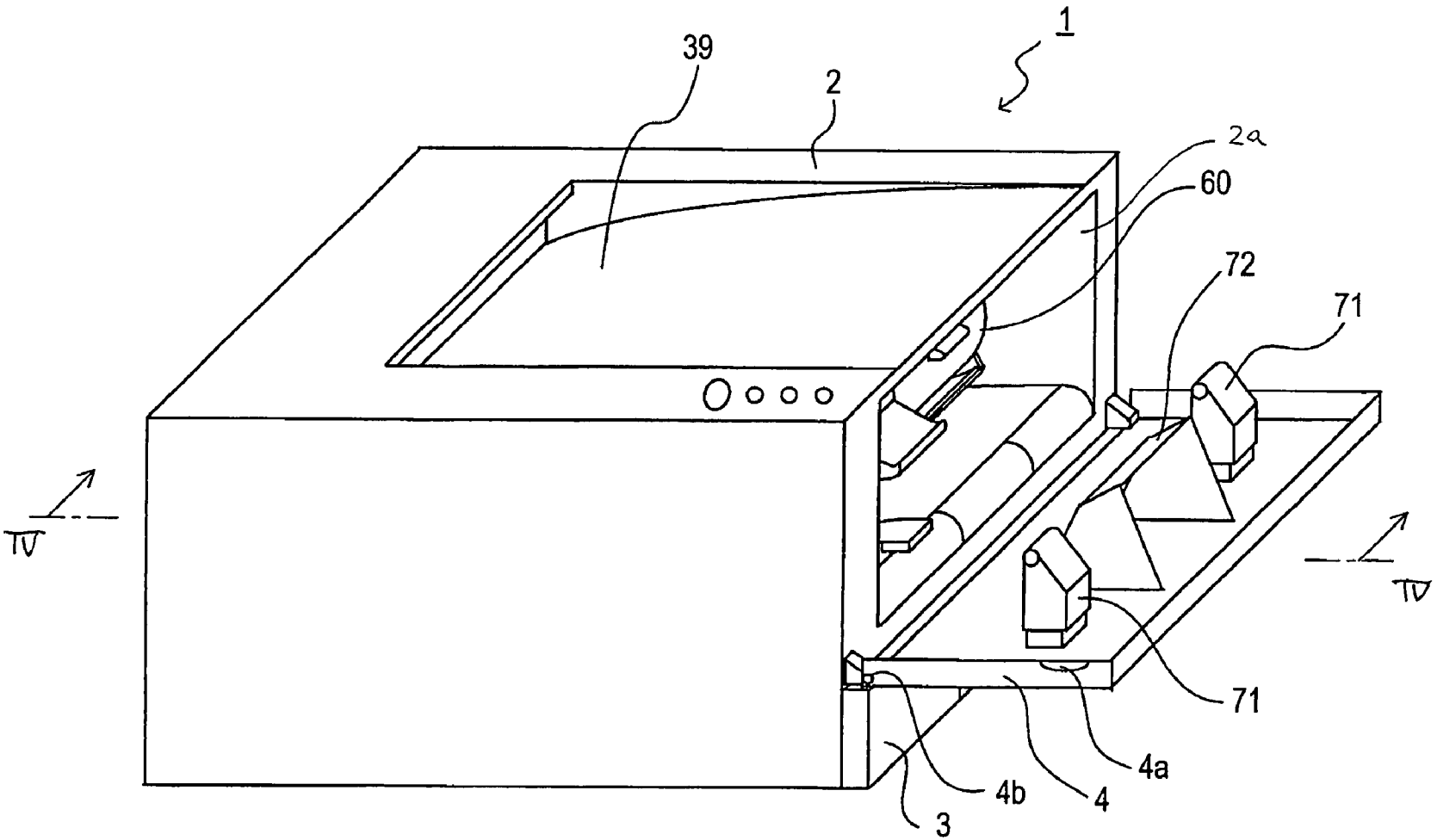
FIG. 2 is a perspective view of the laser printer, illustrating how a lid of the laser printer is opened.

As shown in FIG. 2, the cover 2 defines an opening 2*a* at its front side, and has a lid 4 that can open and close the opening 2*a*. Usually, the lid 4 closes the opening 2*a* as shown in FIG. 1.

The lid 4 has finger rests 4*a* on the upper left and right sides, respectively. The user may hold the lid 4, placing his or her fingers in the finger rests 4*a*, and then pull the lid 4. As a result, as shown in FIG. 2, the lid 4 rotates around a hinge 4*b*, that is located at the lower edge of the lid 4, and opens the opening 2*a*.

Figure 3:
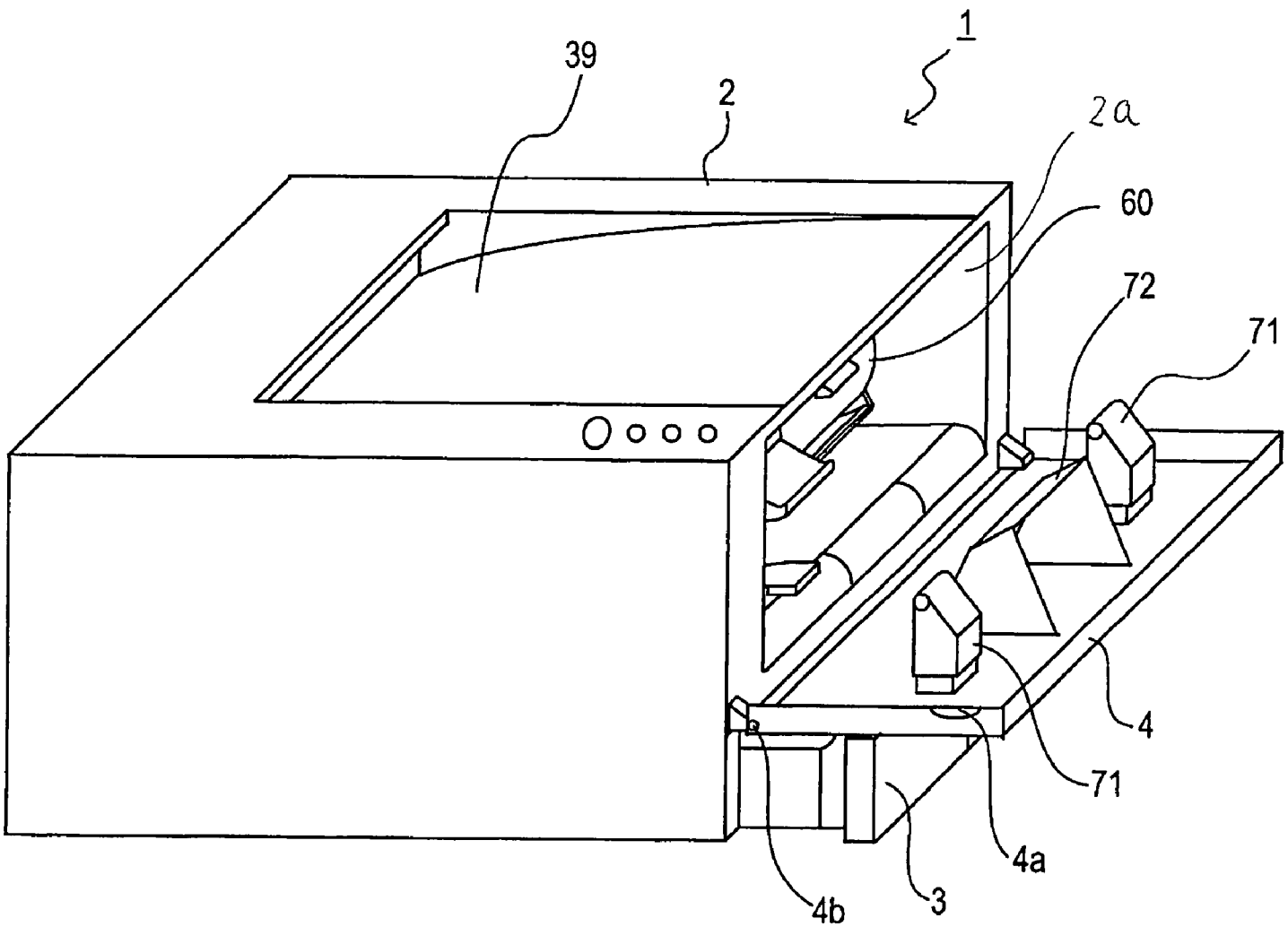
FIG. 3 is a perspective view of the laser printer, illustrating how a sheet cassette is pulled out of the main body of the laser printer.

As shown in FIG. 3, the sheet cassette 3 can be pulled out forwardly from the main body of the laser printer 1. Thus, the sheet cassette 3 can be removed from the main body of the laser printer 1.

Figure 4:
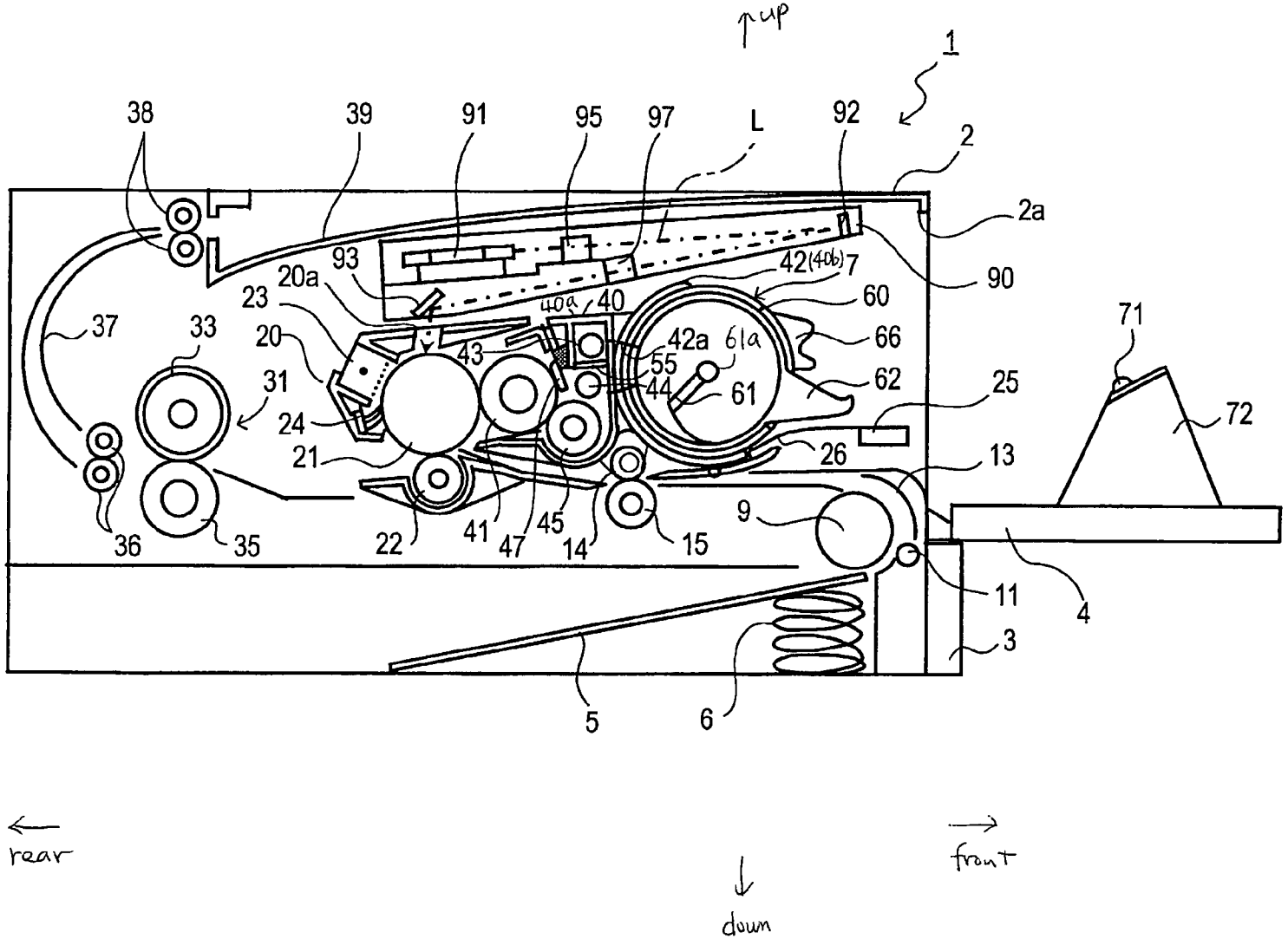
FIG. 4 is a sectional view of the laser printer, taken along a line IV-IV in FIG. 2, showing the internal structure thereof.

As shown in FIG. 4, a spring 6 and a support plate 5 are mounted in the sheet cassette 3. The spring 6 urges the support plate 5 upwardly. A sheet-feeding roller 9 is provided above the front edge of the support plate 5. The sheet-feeding roller 9 is for feeding, one at a time, paper sheets (not shown) that are stuck on the support plate 5 toward an image forming unit 7. Along a sheet conveying path from the sheet-feeding roller 9 to the image forming unit 7, a transport roller 11, a guide 13, and a pair of registration rollers 14 and 15 are arranged in this order. The transport roller 11 cooperates wit the sheet-feeding roller 9 to transport paper sheets. The guide 13 receives a paper sheet transported by the transport roller 11 and turns back the sheet by about 180° along the outer circumference of the transport roller 11. The registration rollers 14 and 15 stop rotating at appropriate timings to catch the leading edge of a paper sheet and eliminate a skew of the paper sheet.

The image forming unit 7 includes a photosensitive drum 21 and a transfer roller 22. The photosensitive drum 21 and the transfer roller 22 are mounted in a photosensitive-drum cartridge 20. The transfer roller 22 is opposed to the photosensitive drum 21. A toner image is formed on a paper sheet as the sheet passes through the nip between the photosensitive drum 21 and the transfer roller 22. The paper sheet is then supplied to a fixing unit 31.

In the fixing unit 31, the toner image on the sheet is fixed as the sheet passes through the nip between a heating roller 33 and a pressing roller 35. The sheet, on which the image is now fixed, is transported by a pair of transport rollers 36.

A guide 37 is provided to guide the paper sheet that has been transported by the transport rollers 36, toward the top of the cover 2. A pair of sheet-discharging rollers 38 discharge the paper sheet onto a sheet tray 39 that is provided on the upper surface of the cover 2.

A scanner unit 90 is provided between the sheet tray 39 and the photosensitive-drum cartridge 20. The scanner unit 90 is for scanning the photosensitive drum 21 with a laser beam L.

Next, the image forming unit 7 and the scanner unit 90 will be described in more detail.

The photosensitive drum 21 is rotatably supported in the photosensitive-drum cartridge 20. The photosensitive drum 21 has a photosensitive layer on the circumferential surface thereof. The transfer roller 22, a scorotron charger 23, and a paper-dust recovering brush 24 are also mounted in the photosensitive-drum cartridge 20. The scorotron charger 23 is for electrically charging the surface of the photosensitive drum 21 uniformly. The photosensitive-drum cartridge 20 is formed with an exposure opening 20*a*. The laser beam L emitted from the scanner unit 90 enters the photosensitive-drum cartridge 20 through the exposure opening 20*a*. The laser beam L forms an electrostatic latent image on the photosensitive drum 21.

A leaf spring 26 is provided on the photosensitive-drum cartridge 20 to hold a development cartridge 40 on the photosensitive drum cartridge 20. A handle 25 is provided on the front free end of the leaf spring 26. The development cartridge 40 is detachably mounted on the photosensitive drum cartridge 20. A developing roller 41 is rotatably mounted in the development cartridge 40. The developing roller 41 supplies toner onto the surface of the photosensitive drum 21, thereby developing the electrostatic latent image into a toner image on the photosensitive drum 21. The toner image is then transferred from the photosensitive drum 21 onto the paper sheet when the paper sheet is passing through the nip between the photosensitive drum 21 and the transfer roller 22.

The paper-dust recovering brush 24 is in abutment contact with the surface of the photosensitive drum 21 at its location downstream, in the rotating direction of the photosensitive drum 21, from the location where the toner image is transferred from the photosensitive drum 21 to the paper sheet. The paper-dust recovering brush 24 is applied with a positive bias, and removes negatively-charged paper dust from the photosensitive drum 21.

As shown in FIG. 4, the developing roller 41 is rotatably supported in the development cartridge 40. The developing roller 41 is driven by a mechanism (later described), while in contact with the photosensitive drum 21.

More specifically, the development cartridge 40 has a developing section 40*a* and a toner-cartridge holding section 40*b*. In the developing section 40*a*, the developing roller 41, an upper auger roller 43, a lower auger roller 44, a toner-supplying roller 45, and a developing blade 47 are mounted in the development cartridge 40.

The development cartridge 40 has a toner-cartridge holder 42 in the toner-cartridge holding section 40*b*.

Figure 7:
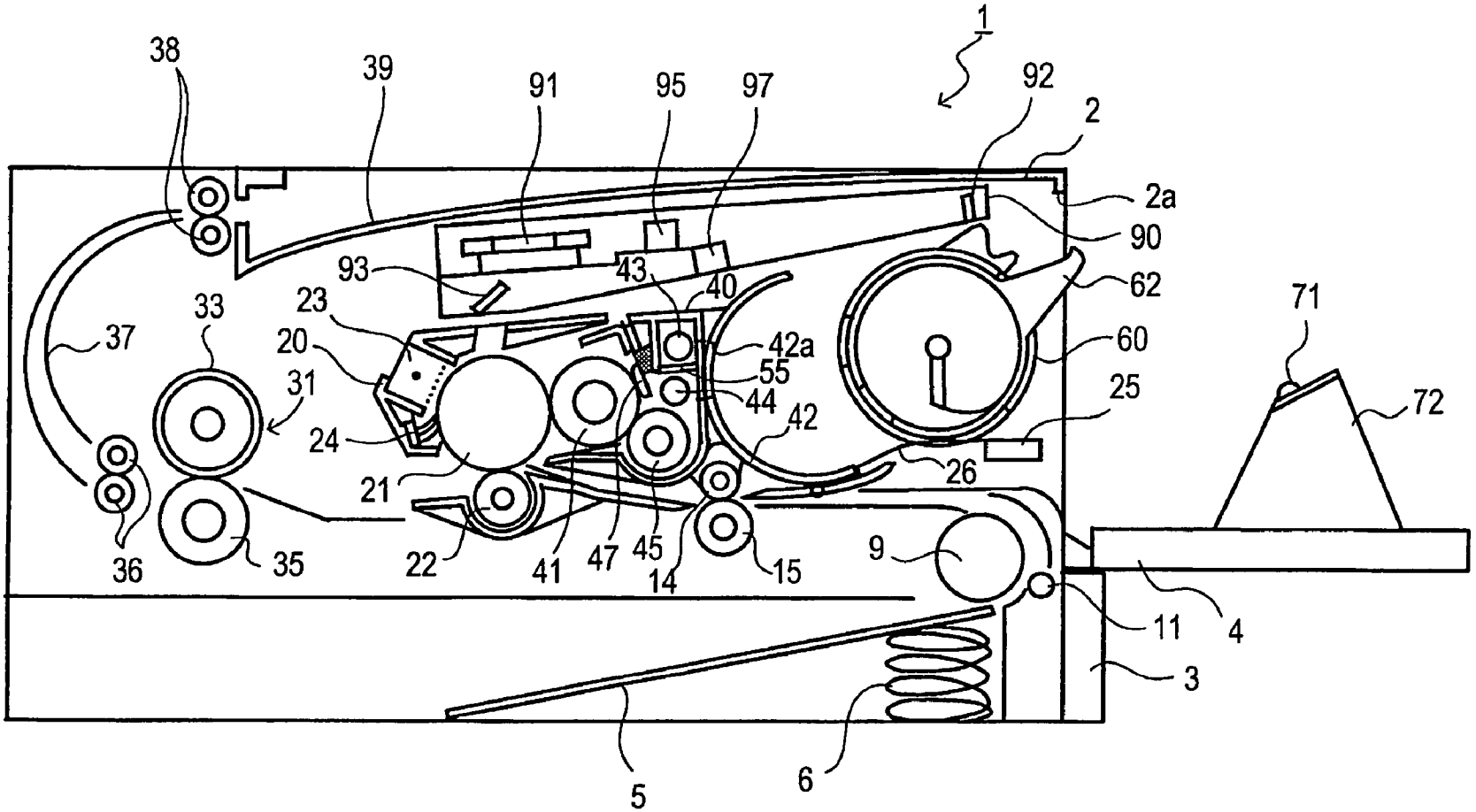
FIG. 7 is a sectional view of the laser printer, illustrating how only the toner cartridge is removed from the main body of the laser printer.

The toner-cartridge holder 42 is of a hollow cylindrical shape that has a peripheral side wall and a pair of end walls (right-side and left-side end walls), with the front parts of the peripheral side wall and the end walls being opened. The toner-cartridge holder 42 is for detachably supporting a toner cartridge 60 on its inner surface, with the front side of the toner cartridge 60 being exposed. The toner-cartridge holder 42 is formed with an opening 42*a* as shown in FIG. 7. Toner is supplied through the opening 42*a* from the toner cartridge 60 into the developing section 40*a*.

Figure 13:
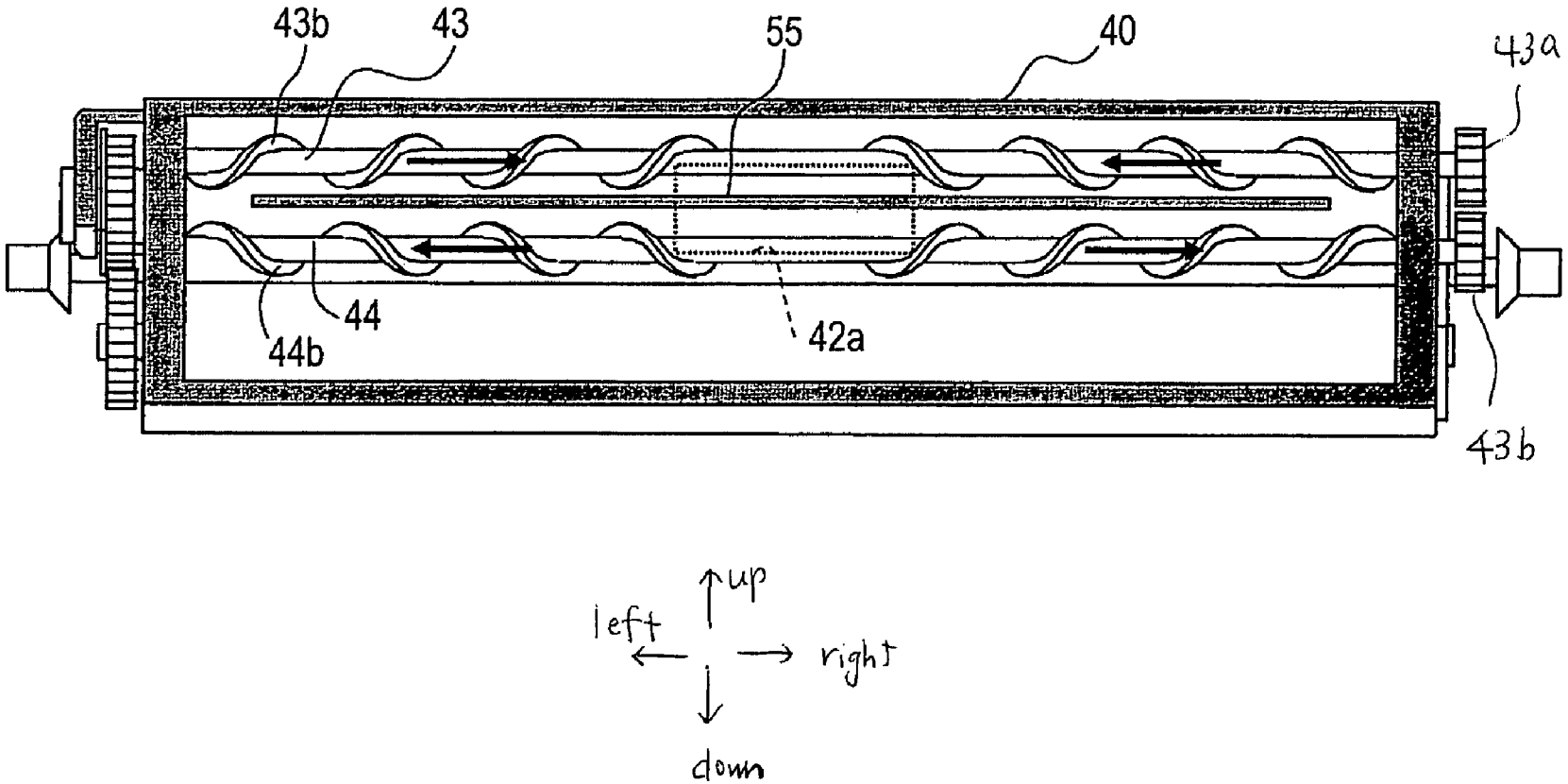
FIG. 13 is a cross-sectional view of the development cartridge, taken along a line in which auger rollers are arranged.

As shown in FIG. 13, the auger rollers 43 and 44 are for receiving toner from the toner cartridge 60 through the opening 42*a*, which confronts the axial middle parts of the auger rollers 43 and 44. The auger rollers 43 and 44 circulate toner along the axial directions thereof between the left and right side ends thereof.

The toner-supplying roller 45 is for receiving toner from the upper and lower auger rollers 43 and 44 and for supplying toner to the developing roller 41. The developing blade 47 is for electrically charging by friction toner that is supplied from the toner-supplying roller 45 onto the surface of the developing roller 41 and for forming a thin layer of toner on the developing roller 41.

An agitator 61 is rotatably supported in the toner cartridge 60. The agitator 61 rotates around its rotational shaft 61*a* to stir the toner in the toner cartridge 60 to supply the toner to the development cartridge 40.

The scanner unit 90 will be described below.

The scanner unit 90 includes a polygon mirrors 92 and 93, an fθ lens 95, and a cylindrical lens 97. The polygon mirror 91 deflects and scans the laser beam L that is emitted from a laser emitting unit (not shown). The mirrors 92 and 93 reflect the laser beam L, guiding the beam L to the photosensitive drum 21. The fθ lens 95 is located on an optical path that extends from the polygon mirror 91 to the mirror 92 . The cylindrical lens 97 is located on another optical path that extends from the mirror 92 to the mirror 93.

The laser unit (not shown) intermittently emits a laser beam L at appropriate timings, while the polygon mirror 91 and the photosensitive drum 21 are being rotated. As a result, an electrostatic latent image is formed on the surface of the photosensitive drum 21. The developing roller 41 supplies toner to the photosensitive drum 21, thereby developing the electrostatic latent image into a toner image. The toner image is then transferred from the photosensitive drum 21 onto a paper sheet. Thus, an image is formed on the paper sheet according to an electronic photography method.

Figure 5:
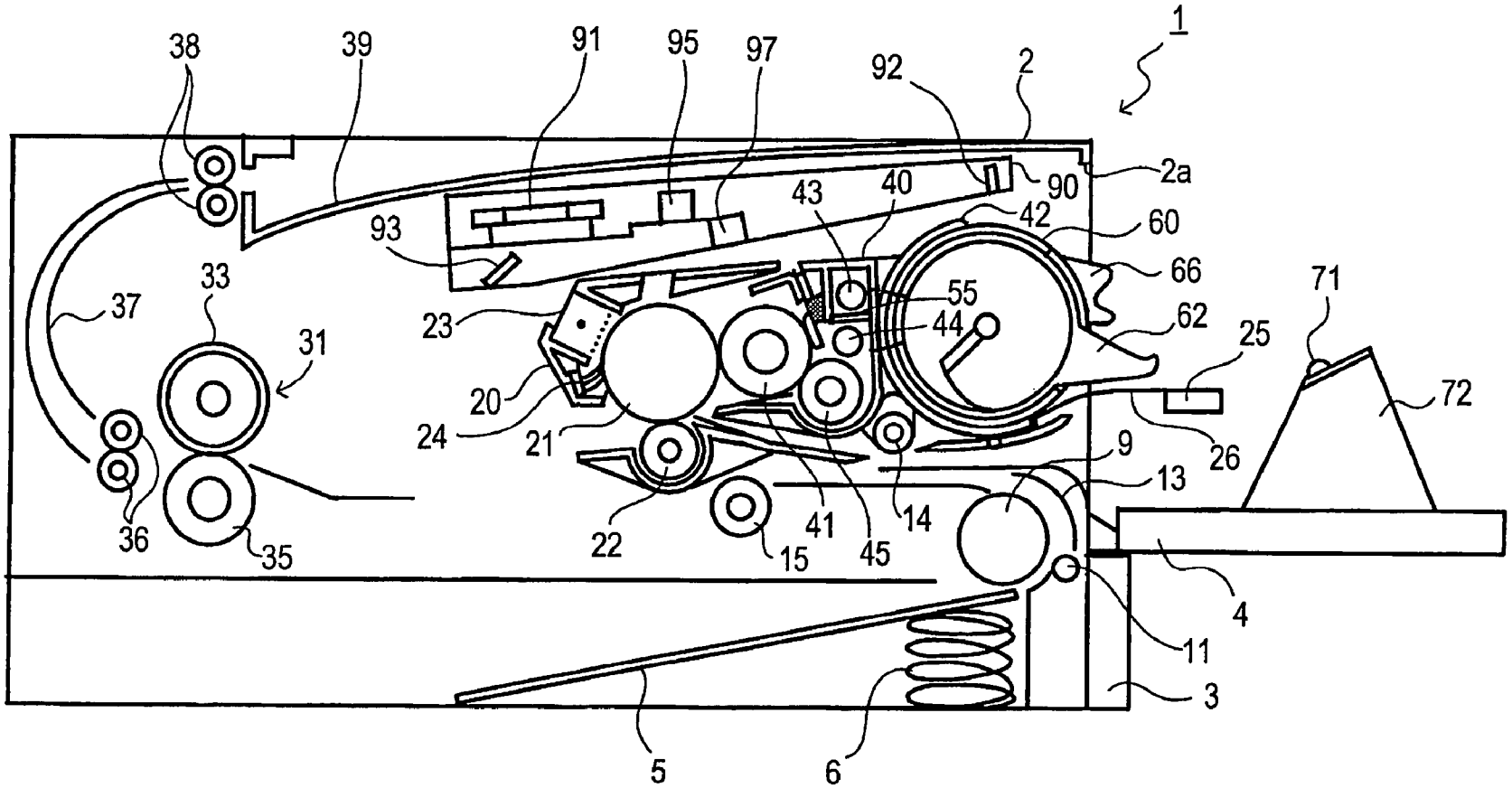
FIG. 5 is a sectional view of the laser printer, illustrating how a photosensitive-drum cartridge, a development cartridge, and a toner cartridge are removed, as an integral unit, from the main body of the laser printer.

As shown in FIG. 5, when the user opens the lid 4 and pulls the handle 25 provided on the photosensitive-drum cartridge 20, the photosensitive-drum cartridge 20 is removed from the main body of the laser printer 1, together with the development cartridge 40 and the toner cartridge 60, through the opening 2*a*.

The toner cartridge 60 has a handle 62. When the user rotates the handle 62 upwards to a disconnecting position shown in FIG. 6, the toner cartridge 60 is disconnected from the development cartridge 40 in a manner described later. The user then pulls the handle 62, whereby only the toner cartridge 60 is removed from the main body of the laser printer 1 through the opening 2*a*, as is illustrated in FIG. 7.

Figure 8:
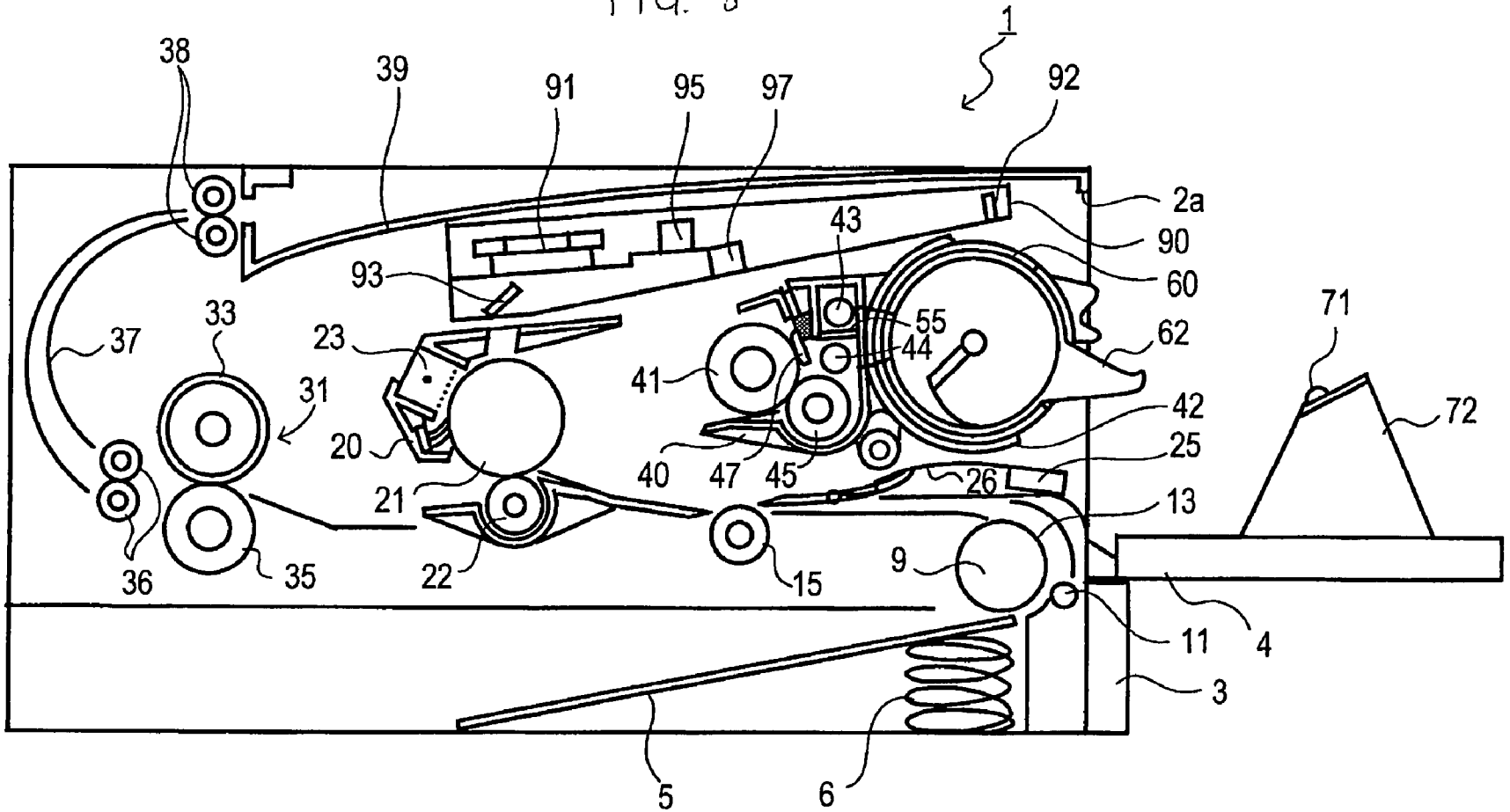
FIG. 8 is a sectional view of the laser printer, illustrating how the development cartridge and the toner cartridge are removed, as an integral unit, from the main body of the laser printer.
Figure 9A:
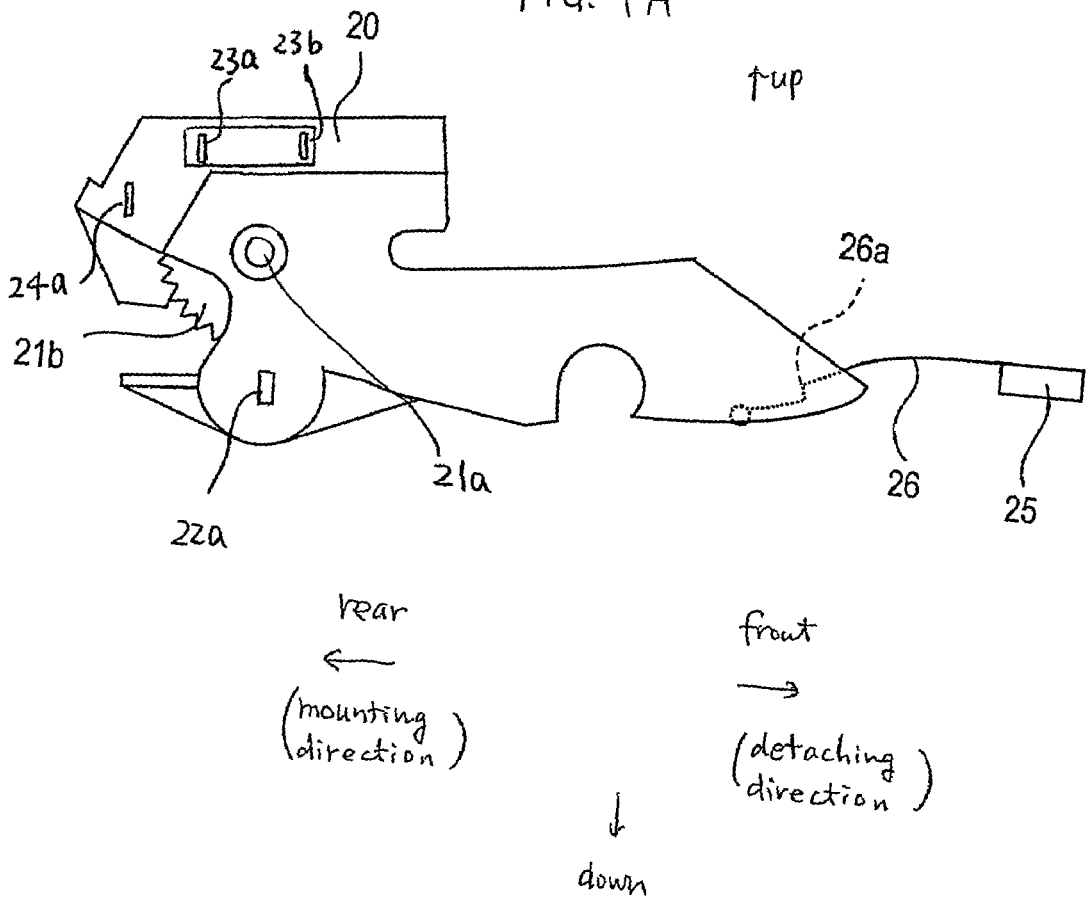
FIG. 9A is a left-side view of the photosensitive-drum cartridge, from which the development cartridge and the toner cartridge are removed.
Figure 9B:
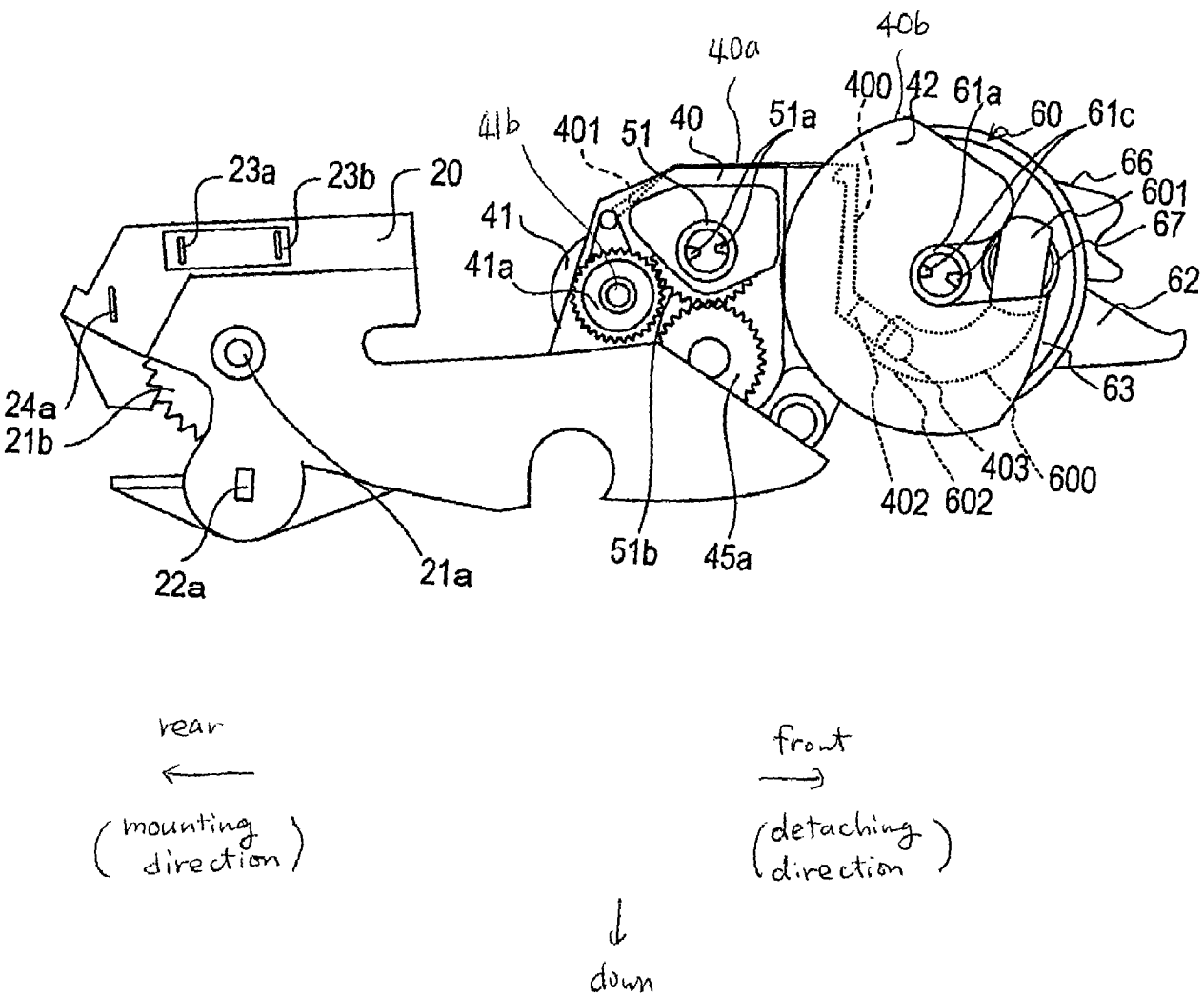
FIG. 9B is a left-side view showing how the toner cartridge set in the development cartridge is detached from the photosensitive-drum cartridge.

As described above, the handle 25 is fixedly secured to the photosensitive-drum cartridge 20 via the leaf spring 26. As shown in FIG. 9A, the leaf spring 26 is bent upwardly at its midpoint, providing a bent part 26*a* that is shaped like a step. When the development cartridge 40 is mounted on the photosensitive-drum cartridge 20 as shown in FIG. 4, the bent part 26*a* comes into engagement with the lower edge of the toner-cartridge holder 42, as a result of which the development cartridge 40 is coupled to the photosensitive-drum cartridge 20. When the handle 25 is pushed down as shown in FIG. 8, the leaf spring 26 is pushed down, and the bent part 26*a* disengages from the lower edge of the toner-cartridge holder 42. The user then pulls the handle 62 forwardly without rotating the handle 62 upwards. In this case, the toner cartridge 60 and the development cartridge 40 are detached together, as an integral unit, from the photosensitive-drum cartridge 20 as shown in FIG. 9B, and are removed from the main body of the laser printer 1 through the opening 2*a* as shown in FIG. 8. It is noted that in FIG. 9B, the leaf spring 26 or the handle 25 is not illustrated for clarity.

Next, the respective components in the image forming unit 7 will be described in detail.

As shown in FIGS. 9A and 9B, electrodes 22*a*, 23*a*, 23*b* and 24*a* are provided on an outer left-side surface of the photosensitive-drum cartridge 20. The electrode 22*a* is for applying a voltage to the transfer roller 22. That is, the electrode 22*a* is electrically connected to the transfer roller 22. The electrodes 23*a* and 23*b* are for applying voltages to a grid and a discharge wire provided in the scorotron charger 23, respectively. That is, the electrodes 23*a* and 23*b* are electrically connected to the grid and the discharge wire, respectively. The electrode 24*a* is for applying a voltage to the paper-dust recovering brush 24. That is, the electrode 24*a* is electrically connected to the paper-dust recovering brush 24. The photosensitive drum 21 has a metal rotational shaft 21*a*, which projects outwardly from the left and right sides of the photosensitive-drum cartridge 20.

Figure 10:
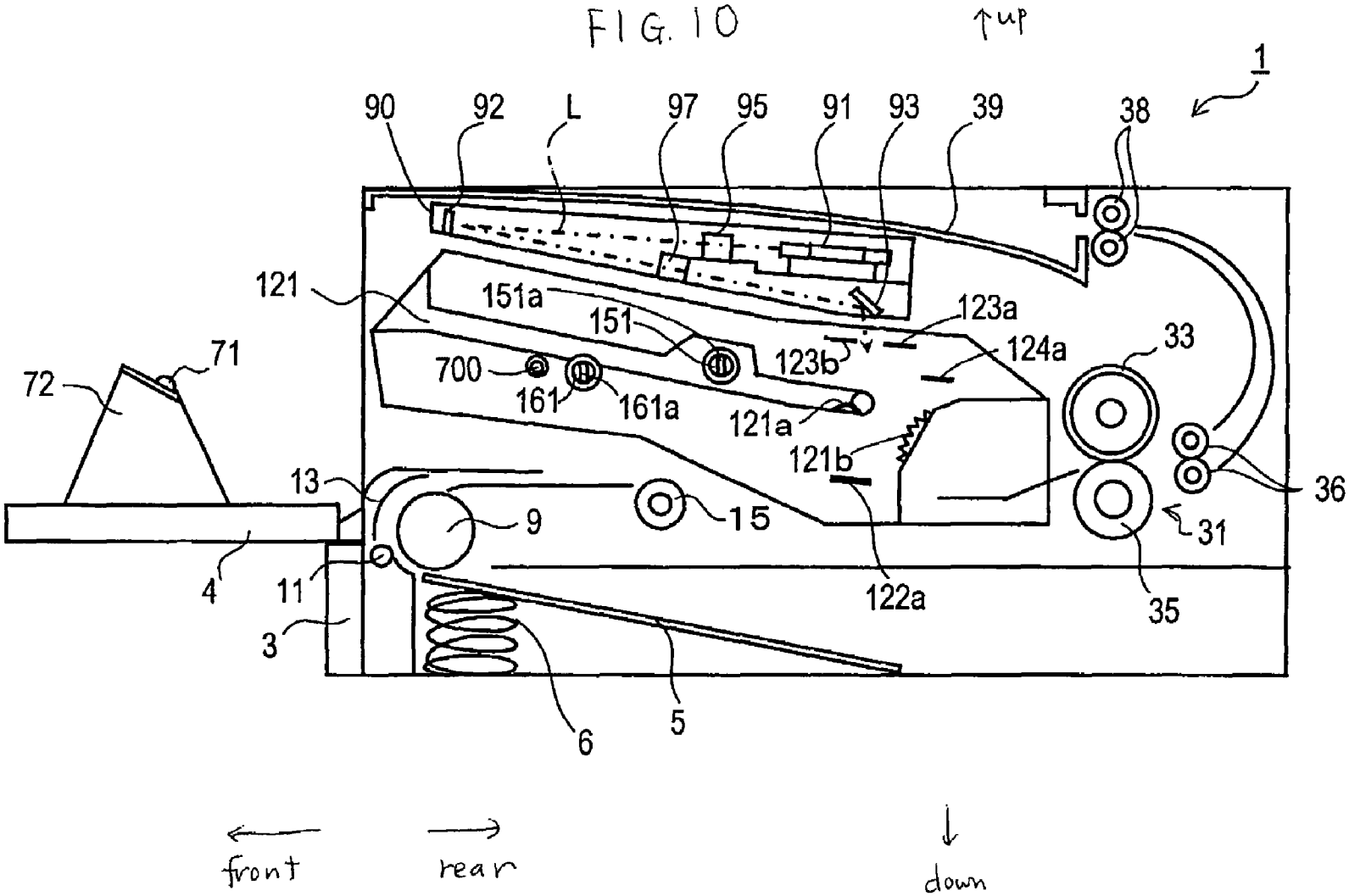
FIG. 10 shows the configuration on the inner surface of a left-side wall in the main body of the laser printer.

As shown in FIG. 10, a guide groove 121 is formed on the inner surface of the left-side wall in the main body of the laser printer 1. The guide groove 121 is for guiding the rotational shaft 21*a* of the photosensitive drum 21. Electrodes 122*a*, 123*a*, 123*b* and 124*a* are provided on the inner surface of the left-side wall in the main body of the laser printer 1. When the photosensitive-drum cartridge 20 is mounted in position in the main body of the laser printer 1, the electrodes 22*a*, 23*a*, 23*b* and 24*a* on the photosensitive-drum cartridge 20 will confront and contact the electrodes 122*a*, 123*a*, 123*b* and 124*a*, respectively.

The electrodes 122*a*, 123*a*, 123*b* and 124*a* are elongated in the horizontal direction, whereas the electrodes 22*a*, 23*a*, 23*b* and 24*a* are elongated in the vertical direction. Hence, even when the electrodes 22*a*, 23*a*, 23*b* and 24*a* are somewhat displaced in the horizontal and vertical directions on the photosensitive-drum cartridge 20, they can reliably contact the electrodes 122*a*, 123*a*, 123*b* and 124*a*, respectively, when the photosensitive-drum cartridge 20 is set in position. Once the electrodes 22*a*, 23*a*, 23*b* and 24*a* contact the electrodes 122*a*, 123*a*, 123*b* and 124*a*, predetermined voltages are applied from the main body of the laser printer 1 to the corresponding components in the image forming unit 7.

An additional electrode 121*a* is provided at a farthest end of the guide groove 121. When the electrode 121*a* contacts the rotational shaft 21*a* of the photosensitive drum 21, the electrode 121*a* electrically grounds the photosensitive drum 21.

As shown in FIGS. 9A and 9B, a gear 21*b* is provided on the left-side end of the photosensitive drum 21. The gear 21*b* rotates integrally with the photosensitive drum 21. The gear 21*b* protrudes from the rear end of the photosensitive-drum cartridge 20. As shown in FIG. 10, a gear 121*b* is provided in the main body of the laser printer 1. When the photosensitive-drum cartridge 20 is set in position in the main body of the laser printer 1, the gear 121*b* is in engagement with the gear 21*b*. Accordingly, a drive force is transmitted from the main body of the laser printer 1 to the photosensitive drum 21.

As shown in FIG. 9B, a drive shaft 51 is provided on the left side of the development cartridge 40 at the developing section 40*a*. The drive shaft 51 is for receiving a drive force from a drive shaft 151, which is provided on the inner surface of the left-side wall in the main body of the laser printer 1 as shown in FIG. 10. The drive shaft 151 has a plate-shaped projection 151*a* on its axial tip end. The drive shaft 51 has: a hollow cylindrical portion at its axial tip end; and a pair of projections 51*a* that are provided within the hollow cylindrical portion. The pair of projections 51*a* can engage with the plate-shaped projection 151*a* of the drive shaft 51. Thus, the drive shaft 151 can be fitted in the drive shaft 51. The drive shafts 51 and 151 constitute a so-called drive coupling.

As shown in FIG. 9B, a gear 51*b* is fixedly mounted on the drive shaft 51. The gear 51*b* is located on the outer side of the left-side wall of the development cartridge 40 at the developing section 40*a*. The gear 51*b* rotates integrally with the drive shaft 51.

A rotational shaft 41*b* of the developing roller 41 and a rotational shaft of the toner-supplying roller 45 protrude outwardly from the left-side wall of the development cartridge 40. A gear 41*a* is fixed on the left-side end of the rotational shaft 41*b*, and rotates integrally with the developing roller 41. A gear 45*a* is fixed on the left-side end of the rotational shaft of the toner-supplying roller 45, and rotates integrally with the toner-supplying roller 45. Thus, the gears 41*a* and 45*a* are located on the outer side of the left-side wall of the development cartridge 40 at the developing section 40*a*. The gear 51*b* is in engagement with both of the gear 41*a* and the gear 45*a*.

Figure 11A:
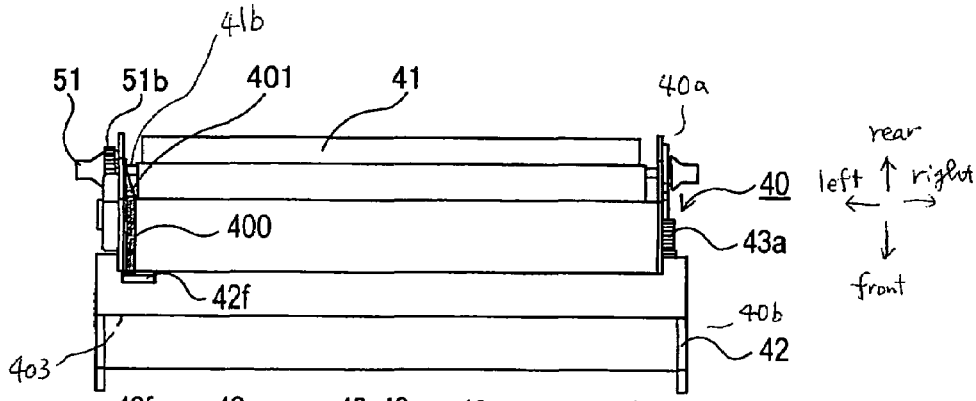
FIG. 11A is a top view of the development cartridge when the toner cartridge is disconnected from the development cartridge.
Figure 11B:
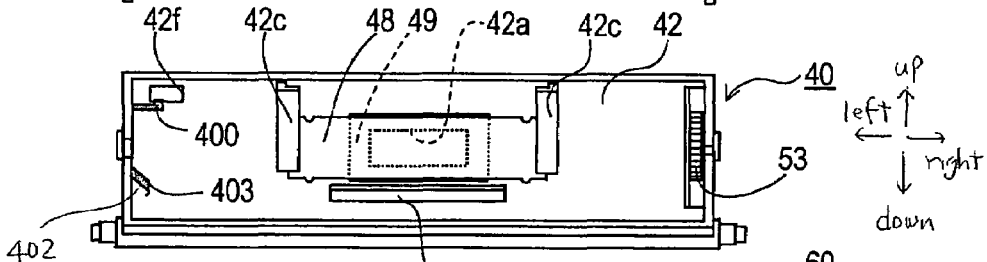
FIG. 11B is a front view of a toner-cartridge holder in the development cartridge as viewed from the toner cartridge side when the toner cartridge is disconnected from the development cartridge.
Figure 11C:
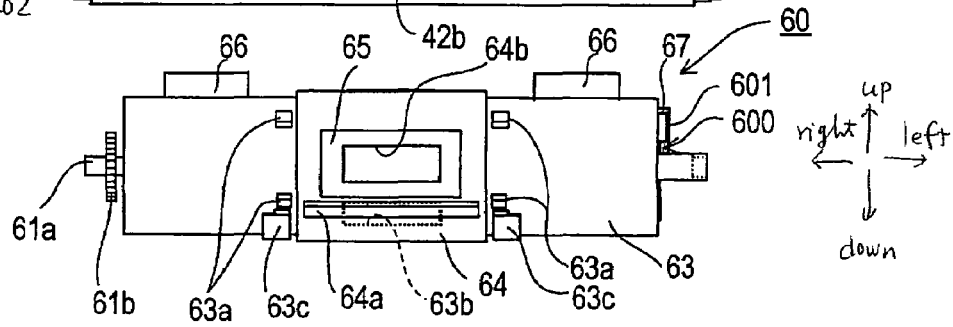
FIG. 11C is a rear view of the toner cartridge as viewed from the toner-cartridge holder side when the toner cartridge is disconnected from the development cartridge.

The toner cartridge 60 can be connected to and disconnected from the development cartridge 40. FIGS. 11B and 11C show the state where the toner cartridge 60 is disconnected from the development cartridge 40, that is, the handle 62 of the toner cartridge 60 has been rotated upwards to the disconnecting position as of FIG. 6. FIG. 11B shows the toner-cartridge holder 42 in the development cartridge 40, as viewed from the toner cartridge 60 side, and FIG. 11C shows the toner cartridge 60 as viewed from the toner-cartridge holder 42 side.

As shown in FIG. 11C, the toner cartridge 60 has an inner cylinder 63 and an outer cylinder 64.

The inner cylinder 63 is a longitudinal hollow cylinder-shaped casing that has a peripheral side wall and a pair of opposite end walls (right-side and left-side end walls). The inner cylinder 63 contains toner therein. The rotational shaft 61*a* of the agitator 61 extends along the central axis of the inner cylinder 63. The rotational shaft 61*a* protrudes outwardly from the pair of opposite end walls (right-side and left-side end walls) of the inner cylinder 63. A gear 61*b* is provided on the right-side end of the rotational shaft 61*a* and is therefore located on the outer side of the right-side end wall of the inner cylinder 63. The gear 61*b* rotates integrally with the rotational shaft 61*a*.

The outer cylinder 64 is coaxial with the inner cylinder 63 and surrounds the axial central part of the inner cylinder 63. The inner and outer cylinders 63 and 64 are supported by the cylindrical toner-cartridge holder 42 coaxially.

The outer cylinder 64 has an elongated projection 64*a* on its outer peripheral surface. The elongated projection 64*a* projects toward the inner peripheral surface of the toner-cartridge holder 42. The toner-cartridge holder 42 has an elongated groove 42*b* on its inner peripheral surface. The outer cylinder 64 is supported by the toner-cartridge holder 42, with the elongated projection 64*a* being fined in the elongated groove 42*b*. Hence, the outer cylinder 64 is fixedly secured to the toner-cartridge holder 42 and cannot rotate relative to the outer cylinder 64.

The handle 62 is formed integrally with the inner cylinder 63. The inner cylinder 63 can rotate around its central axis relative to the outer cylinder 64 when the user operates the handle 62 to move the handle 62 upwardly or downwardly.

As shown in FIG. 11B, a pair of rails 42*c* are provided on the inner peripheral surface of the toner-cartridge holder 42. A shutter 48 made of metal is slidably mounted on the pair of rails 42*c* at its pair of opposite ends. The shutter 48 is of a rectangular shape that is elongated in the axial direction of the toner-cartridge holder 42. The shutter 48 can move along the circumference of the cylindrical toner-cartridge holder 42, between the closing position where the shutter 48 closes the opening 42*a* as shown in FIG. 11B and the opening position (not shown) where the shutter 48 is shifted upwardly from the opening 42*a* to expose the opening 42*a*.

Two pairs of projections 63*a* are provided on the outer peripheral surface of the inner cylinder 63. The two pairs of projections 63*a* are separate from each other in the circumferential direction of the inner cylinder 63 as sandwiching the shutter 48 therebetween. Two projections 63*a* constituting each pair are separate from each other in the axial direction of the inner cylinder 63 and confront the two opposite longitudinal ends of the shutter 48. As the inner cylinder 63 rotates, the two pairs of projections 63*a* move the shutter 48 while holding it therebetween in the circumferential direction along the inner peripheral surface of the toner-cartridge holder 42. When the handle 62 is rotated to the disconnecting position shown in FIG. 6, the shutter 48 closes the opening 42*a* as shown in FIG. 11B.

The elongated groove 42*b* is located on the inner peripheral surface of the toner-cartridge holder 42 at a position below the shutter 48 and not overlapping the shutter 48 even when the shutter 48 is moved to its lowest position shown in FIG. 11B to completely close the opening 42*a*.

The opening 42*a* is of a rectangular shape that is elongated in the axial direction of the toner-cartridge holder 42. A sponge member 49 in a rectangular frame shape is bonded to the inner peripheral surface of the toner-cartridge holder 42 around the opening 42*a*.

A pair of engagement members 63*c* are formed on the outer peripheral surface of the inner cylinder 63 integrally with the inner cylinder 63. The pair of engagement members 63*c* are provided on the inner cylinder 63 at such locations that the engagement members 63*c* can engage with the pair of rails 42*c* when the handle 62 of the inner cylinder 63 is in a coupling position shown in FIGS. 4 and 9B. It is noted that each rail 42*c* has an L-shaped cross-section, while each engagement member 63*c* has a cross-sectional shape that can be engaged with the L-shaped cross-section of the corresponding rail 42*c*.

The outer cylinder 64 is formed with an opening 64*b* that has the same shape as the opening 42*a*. The opening 64*b* is provided in the outer cylinder 64 at such a position that the opening 64*b* will confront the opening 42*a* when the outer cylinder 64 is mounted in the toner-cartridge holder 42 with the elongated projection 64*a* being fitted in the elongated groove 42*b*. A sponge member 65 in the same shape with the sponge member 49 is bonded to the outer peripheral surface of the outer cylinder 64 around the opening 64*b*.

The inner cylinder 63 is formed with an opening 63*b* that has the same shape with the opening 64*b*. As shown in FIG. 11C, the openings 64*b* and 63*b* do not overlap with each other when the handle 62 is in the disconnecting position of FIG. 6. This ensures that toner will not come out from the toner cartridge 60 when the toner cartridge 60 is removed from the development cartridge 40 as shown in FIG. 7.

Figure 6:
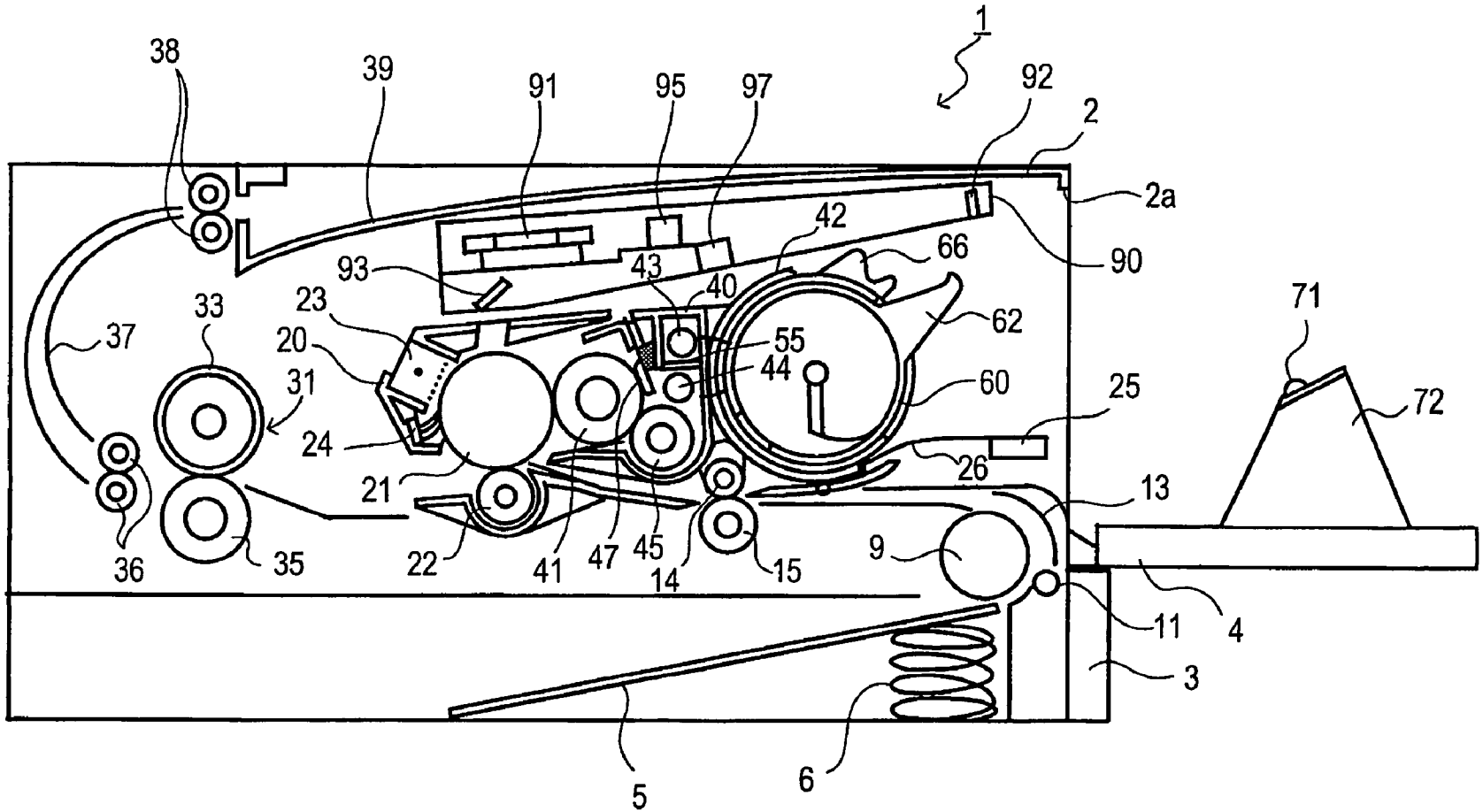
FIG. 6 is a sectional view of the laser printer, illustrating how the toner cartridge is disconnected from the development cartridge.

The handle 62 of the toner cartridge 60 can be rotated from the disconnecting position of FIG. 6 downwards to the coupling position shown in FIGS. 4 and 9B, while maintaining the elongated projection 64*a* to be fitted in the elongated groove 42*b*. As a result, the openings 64*b* and 63*b* become overlapping with each other, and the projections 63*a* push up the shutter 48 from the opening 42*a*. As a result, the inside of the inner cylinder 63 is brought into fluid communication with the inside of the developing section 40*a* of the development cartridge 40. Toner can therefore be supplied from the toner cartridge 60 to the developing section 40*a* in the development cartridge 40.

At this time, the sponge members 49 and 65 come into firm contact with each other, and the engagement members 63*c* are engaged with the rails 42*c*. Accordingly, the entire periphery of the openings 64*b* and 42*a* are tightly sealed, allowing no toner to come outside. When the engagement members 63*c* are thus engaged with the rails 42*c*, the development cartridge 40 and the toner cartridge 60 are coupled to each other as shown in FIGS. 4 and 9B. Accordingly, the cartridges 40 and 60 can be removed and inserted, as an integral unit, from and onto the photosensitive-drum cartridge 20 as shown in FIGS. 8 and 9B. Thus, the cartridges 40 and 60 can be removed and inserted, as an integral unit, from and into the main body of the laser printer 1 as shown in FIG. 8.

The handle 62 may be operated to rotate the inner cylinder 63 to release the engagement members 63*c* from the rails 42*c*. Thus, the development cartridge 40 and the toner cartridge 60 are disconnected from each other. Accordingly, only the toner cartridge 60 can be removed as shown in FIG. 7.

Figure 12:
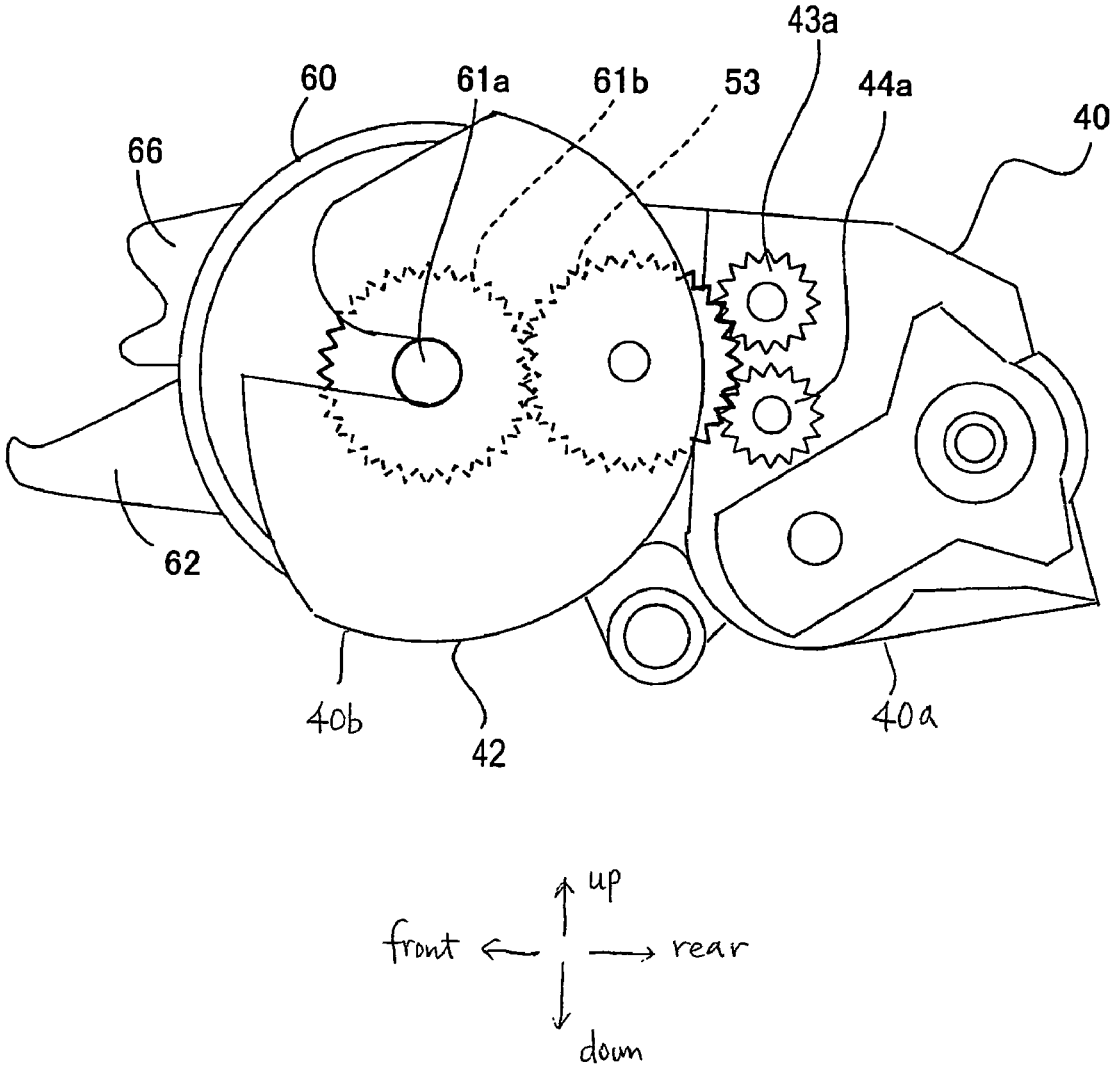
FIG. 12 is a right-side view showing the toner cartridge and the development cartridge when they are coupled with each other.

As shown in FIG. 11B and FIG. 12, a gear 53 is mounted on the inner side of the right-side end wall of the toner-cartridge holder 42. The gear 53 is engaged with the gear 61*b* when the toner cartridge 60 is set in the toner-cartridge holder 42.

As shown in FIG. 13, the upper auger roller 43 and the lower auger roller 44 protrude outwardly from the right-side wall of the development cartridge 40. As shown in FIGS. 12 and 13, gears 43*a* and 44*a* are attached to the right-side ends of the upper auger roller 43 and the lower auger roller 44, respectively. Accordingly, the gears 43*a* and 44*a* are located on the outer side of the right-side wall of the development cartridge 40. The gears 43*a* and 44*a* rotate integrally with the upper auger roller 43 and the lower auger roller 44, respectively. The gear 53 is in engagement with both of the gears 43*a* and 44*a*.

As shown in FIG. 10, a drive shaft 161 is provided on the inner surface of the left-side wall in the main body of the laser printer 1. The drive shaft 161 and the rotational shaft 61*a* of the agitator 61 constitute a so-called drive coupling. More specifically, the drive shaft 161 has a plate-shaped projection 161*a* on its axial tip end. As shown in FIG. 9B, the rotational shaft 61*a* has a hollow cylindrical portion at its left-side axial end, and a pair of projections 61*c* provided within the hollow cylindrical portion. The pair of projections 61*c* can engage with the plate-shaped projection 161*a* of the drive shaft 161. Thus, the drive shaft 161 can be fined in the rotational shaft 61*a*.

The agitator 61 is rotated when a drive force is transmitted to the rotational shaft 61*a* from the drive shaft 161. The drive force is transmitted from the gear 61*b* to the gear 53, and then from the gear 53 to the gears 43*a* and 44*a*. As a result, the auger rollers 43 and 44 are rotated.

As shown in FIG. 13, the upper auger roller 43 and lower auger roller 44 have spiral blades 43*b* and 44*b*, respectively. When the agitator 61 is driven, the lower auger roller 44 transports toner from the opening 42*a* to the left and right sides of the development cartridge 40, and the upper auger roller 43 transports toner from the left and right sides of the development cartridge 40 back to the middle part of the development cartridge 40, as indicated by arrows in the figure. The toner can therefore be recovered from the right and left sides of the development cartridge 40 to the middle part thereof and returned back to the toner cartridge 60 through the opening 42*a*.

Therefore, the toner can not only be circulated in the development cartridge 40, but also be supplied back and forth between the development cartridge 40 and the toner cartridge 60. This prevents degraded toner from accumulating or coagulating at a particular position to be firmly adhered thereto, thereby maintaining fluidity of toner.

As shown in FIG. 13, a partition wall 55 is provided in the development cartridge 40 at a location between the upper auger roller 43 and the lower auger roller 44. The partition wall 55 helps to transport toner smoothly.

Electrode members 400 and 600 are provided on the development cartridge 40 and the toner cartridge 60, respectively as shown in FIG. 9B and FIGS. 11A, 11B and 11C. The electrode members 400 and 600 are for applying a bias voltage to the developing roller 41.

The toner-cartridge holder 42 is formed with a through-hole 42*f*.The electrode member 400 is connected at one end 401 to the rotational shaft 41*b* of the developing roller 41, and extends though the through-hole 42*f*. The electrode member 400 then extends along the inner surface of the left-side end wall of the toner-cartridge holder 42. The electrode member 400 then rises, at its near-to-end part 402 that is near to the other end 403, inwardly (rightwardly) from the inner surface of the left-side end wall of the toner-cartridge holder 42. The other end 403 of the electrode member 400 is spaced away from the inner surface of the left-side end wall in the toner-cartridge holder 42 due to the resilient force of the near-to-end part 402 of the electrode member 400.

The left-side end wall of the inner cylinder 63 is formed with a toner-filling port (opening) that is closed by a cap 67. The electrode member 600 has a pair of opposite ends 601 and 602. The opposite end 601 of the electrode member 600 is mounted on an outer surface of the cap 67. When the cap 67 is removed from the inner cylinder 63, the toner-filling port can be opened so that the toner cartridge 60 can be refilled with toner. The electrode member 600 extends on the outer surface of the left-side end wall of the inner cylinder 63 from its opposite end 601 to its opposite end 602 in a circular arc shape whose center is located on the rotational shaft 61*a*, that is, on the central or rotational axis of the inner cylinder 63.

Hence, when the handle 62 is rotated to the coupling position shown in FIG. 9B, the opposite end 602 of the electrode member 600 enters the gap between the other end 403 of the electrode member 400 and the outer surface of the left-side end wall of the toner cartridge 60, while pushing the other end 403 of the electrode member 400 toward the inner surface of the left-side end wall of the toner-cartridge holder 42. As a result, the electrode members 400 and 600 are electrically connected to each other. At this time, the opposite end 601 of the electrode member 600 is exposed outside the toner-cartridge holder 42, while the electrode member 400 and the other remaining part of the electrode member 600 is not exposed.

As shown in FIG. 10, an electrode 700 is provided on the inner surface of the left-side wall in the main body of the laser printer 1 and is opposed to the opposite end 601 of the electrode member 600. The electrode 700 applies a bias voltage to the developing roller 41 via the electrode members 600 and 400 when the development cartridge 40 and the toner cartridge 60 are mounted in the main body of the laser printer 1.

Figure 14:
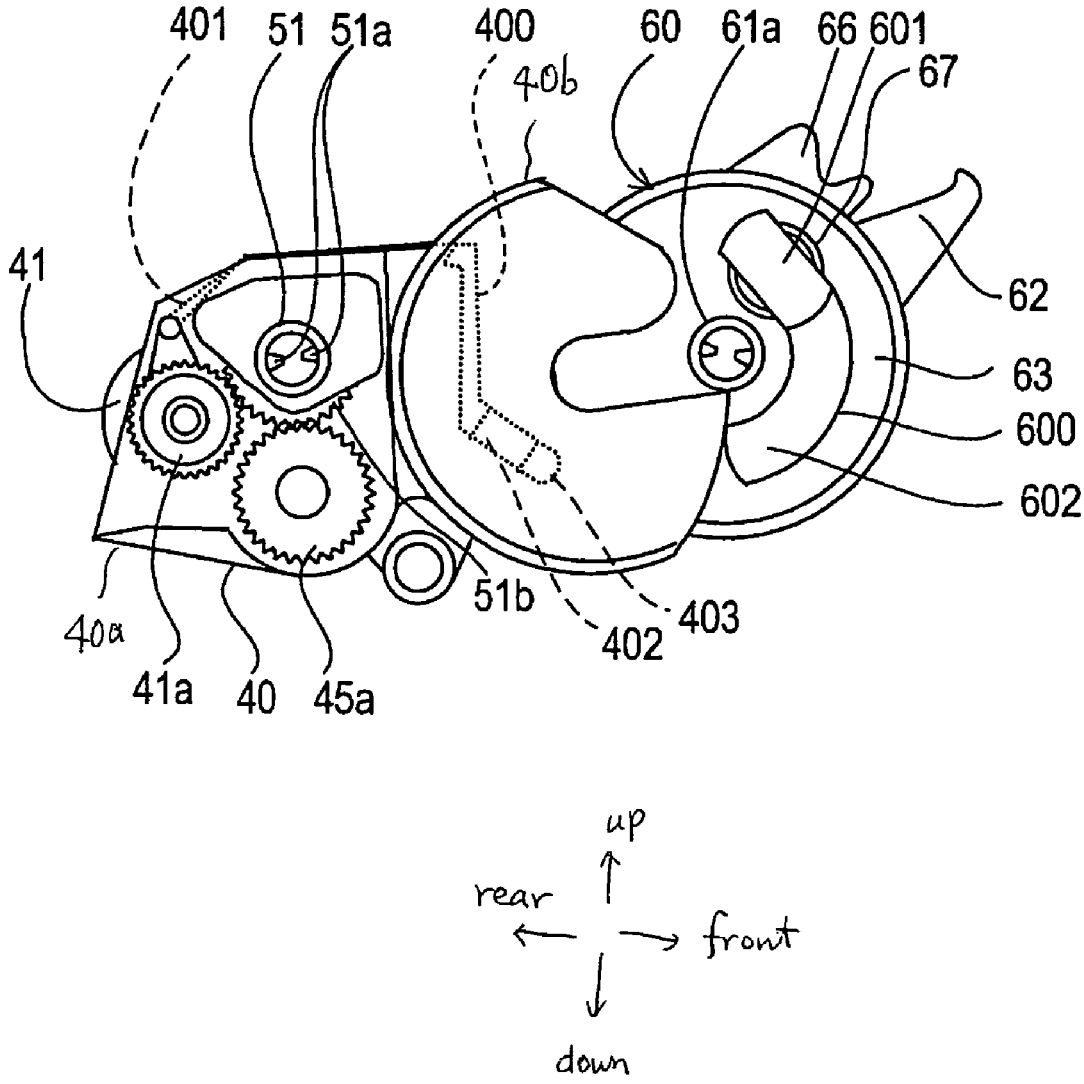
FIG. 14 is a left-side view showing the toner cartridge detached from the development cartridge.

When the handle 62 is rotated to the disconnecting position, the opposite end 602 of the electrode member 600 is separated from the electrode member 400. Thus, the toner cartridge 60 can be removed from the development cartridge 40 as illustrated in FIG. 14.

The electrode 700 and the drive shafts 151 and 161 are provided on the left-side wall in the main body of the laser printer 1 as being capable of protruding and retracting together. More specifically, the electrode 700 and drive shafts 151 and 161 are connected to a link mechanism (not shown), and protrude when the lid 4 is closed and retract when the lid 4 is opened. When the lid 4 is opened, the electrode 700 is brought out of contact from the electrode member 600 and the drive shafts 151 and 161 are brought out of engagement from the drive shaft 51 and rotational shaft 61*a*, respectively. Thus, the photosensitive-drum cartridge 20, development cartridge 40 and toner cartridge 60 can be removed from the main body of the laser printer 1. On the other hand, when the lid 4 is closed, the electrode 700 is brought into contact with the electrode member 600 and the drive shafts 151 and 161 are brought into engagement with the drive shaft 51 and rotational shaft 61*a*, respectively. As a result, a bias voltage is applied to the developing roller 41 and various components can be driven.

As shown in FIG. 11C, a pair of spring receptacles 66 are provided on the outer surface of the inner cylinder 63. The spring receptacles 66 are located slightly above the left- and right-side ends of the handle 62. Each spring receptacle 66 has a recess in the middle part in the circumferential direction of the inner cylinder 63. As shown in FIG. 2, a pair of pushing members 71 project from the rear surface of the lid 4. Each pushing member 71 is urged in its protruding direction by a spring (not shown) that is installed in the pushing member 71. The spring receptacles 66 receive the pushing force from the pushing members 71 when the lid 4 is closed. The pushing force reliably holds the cartridges 20, 40 and 60 in their mounting positions.

An interference member 72 also protrudes from the rear surface of the lid 4 at a location between the pair of pushing members 71. The interference member 72 interferes with the handle 62 unless the handle 62 is placed at the coupling position shown in FIG. 4. Hence, the lid 4 cannot be closed until the handle 62 is properly placed at the coupling position.

As described above, a voltage is applied to the developing roller 41 from the opposite end 601 of the electrode member 600 that is provided on the toner cartridge 60. The opposite end 601 of the electrode member 600 is spaced apart from the electrodes 22*a*, 23*a*, 23*b* and 24*a* that are provided on the photosensitive-drum cartridge 20 by a sufficiently long distance. This reliably prevents leakage from occurring.

It is noted that the photosensitive drum 21 will possibly be damaged if a voltage were applied to the developing roller 41 when no toner exists between the photosensitive drum 21 and the developing roller 41. However, according to this aspect, no voltage is applied to the developing roller 41 when the toner cartridge 60 is disconnected from the development cartridge 40. This ensures that no voltage is applied to the developing roller 41 when no toner exists between the photosensitive drum 21 and the developing roller 41. This ensures that the photosensitive drum 21 be prevented from being damaged.

The electrode members 400 and 600 are unexposed outside, except the opposite end 601, as long as the toner cartridge 60 is set on the development cartridge 40. More specifically, the electrode member 400 is exposed outside only at its part that is located on the inner surface of the toner-cartridge holder 42 and therefore that will confront the toner cartridge 60 when the toner cartridge 60 is mounted in the toner-cartridge holder 42. Accordingly, when the toner cartridge 60 is mounted in the toner-cartridge holder 42, the originally-exposed part of the electrode member 400 becomes unexposed. When the toner cartridge 60 is mounted in the toner-cartridge holder 42, only the opposite end 601 of the electrode member 600 is exposed outside. This prevents leakage more reliably.

No voltage is applied to the developing roller 41 when the handle 62 stays at the disconnecting position and keeps the shutter 48 closed. This reliably prevents the photosensitive drum 21 from being damaged.

Voltages and drive forces are applied to the cartridges 20, 40, and 60 entirely from the left-side wall of the main body in the laser printer 1. Accordingly, wires can be laid and drive forces can be transmitted, in a simple way, in the main body of the laser printer 1.

The toner cartridge 60 has such a simple structure that the rotational shaft 61*a* of the agitator 61 is aligned with the rotational axis of the inner cylinder 63. The inner cylinder 63 will possibly rotate a little as the shaft 61*a* is driven to rotate the agitator 61. Still, reliable electrical connection between the electrode members 400 and 600 is maintained because the electrode member 600 extends along the circular arc whose center is located on the rotational shaft 61*a*.

The opposite end 601 of the electrode member 600 is attached on the outer surface of the cap 67. The cap 67 protrudes outwardly (leftwardly) from the outer surface of the left-side end wall of the inner cylinder 63. Accordingly, the opposite end 601 of the electrode member 600 protrudes in a direction toward the electrode 700 that is provided on the left-side wall in the main body of the laser printer 1. When the cap 67 is removed from the inner cylinder 63, the entire part of the electrode member 600 including the opposite end 601 is also removed from the inner cylinder 63 together with the cap 67. This ensures that no voltage will be applied to the opposite end 601 of the electrode member 600 when the cap 67 has erroneously come off the inner cylinder 63.

As described above, the opposite end 601 of the electrode member 600 is configured to receive an electric power from the electrode 700. The opposite end 602 of the electrode member 600 that is connected with the opposite end 601 is configured to contact the development cartridge 40. The opposite end 602 is provided at a different area where the opposite end 601 is provided. Both of the opposite ends 601 and 602 are located in a circular arc.

It is noted that the inner cylinder 63 moves in a circular arc path, wit the electrode member 600 moving in the circular arc path together with the inner cylinder 63. The axis of the circular arc path coincides with the rotation axis of the agitator 61 (rotational axis of the rotational shaft 61*a*). A drive force is inputted from the drive shaft 161 to the rotational shaft 61*a* via the drive coupling, whereupon the agitator 61 is rotated by the drive force. The gear 61*b* provided on the rotational shaft 61*a* outputs the drive force to the auger rollers 43 and 44.

More specifically, when mounting the toner cartridge 60 in the toner-cartridge holder 42 of the development cartridge 40, the toner cartridge 60 is first mounted in the toner-cartridge holder 42. As a result, the inner and outer cylinders 63 and 64 of the toner cartridge 60 are located coaxially with the cylindrical toner-cartridge holder 42, and the elongated projection 64*a* of the outer cylinder 64 is fitted in the elongated groove 42*b*. At this time, the gear 61*b* is brought into engagement with the gear 53. Then, the inner cylinder 63 is rotated about its central axis relative to the outer cylinder 64 so that the toner cartridge 60 is completely mounted in the development cartridge 40. In other words, the inner cylinder 63 is rotated about its central axis relative to the outer cylinder 64 until the engagement members 63*c* are brought into engagement with the rails 42*c*, the opposite end 602 of the electrode member 600 is brought into electrical connection with the other end 403 of the electrode member 400, and the inside of the inner cylinder 63 is brought into fluid communication with the inside of the developing section 40*a* of the development cartridge 40. After the toner cartridge 60 is completely mounted in the development cartridge 40, the drive force is inputted from the drive shaft 161 to the drive shaft 61*a*, and the electrical power is inputted from the electrode 700 to the opposite end 601 of the electrode member 600. The agitator 61 rotates, and the drive force is properly transmitted from the rotational shaft 61*a* of the agitator 61 via the gear 61*b* to the auger rollers 43 and 44. The electric power is supplied to the developing roller 41 through the electrode members 600 and 400. Because the rotational axis of the gear 61*b*, the rotational axis of the agitator 61 (rotational shaft 61*a* ), and the axis of the circular arc path along which the electrode member 600 extends, coincide with one another and extend along the central axis of the inner cylinder 63, it is possible to easily mount the toner cartridge 60 to the development cartridge 40. It is ensured that the drive force is properly transmitted from the agitator to the auger rollers 43 and 44 and that the electric power is properly transmitted via the toner cartridge 60 to the developing roller 41.

In the above description, the electrode member 600 extends along the circular arc path. However, the electrode member 600 may not extend along the circular arc path. It is sufficient that at least both of the opposite ends 601 and 602 of the electrode member 600 be located in the circular arc path.

In the above description, after the toner cartridge 60 is mounted in the development cartridge 40, the electrode members 400 and 600 are connected together after the inner cylinder 63 is rotated relative to the outer cylinder 64. However, the electrode members 400 and 600 may be designed so that they are connected together directly after the toner cartridge 60 is mounted in the development cartridge 40. It is unnecessary to rotate the inner cylinder 63 relative to the outer cylinder 64.

In the above description, the electrode member 600 is provided on the outer surface of the inner cylinder 63. However, a large or small part of the electrode member 600 may be provided in the inside of the inner cylinder 63. It is sufficient that at least the opposite ends 601 and 602 of the electrode member 600 be provided on the outer surface of the inner cylinder 63.

The electrode members 400 and 600 may be modified as shown in FIGS. 15A to 15D and FIGS. 16A to 16C according to an additional aspect.

Figure 15A:
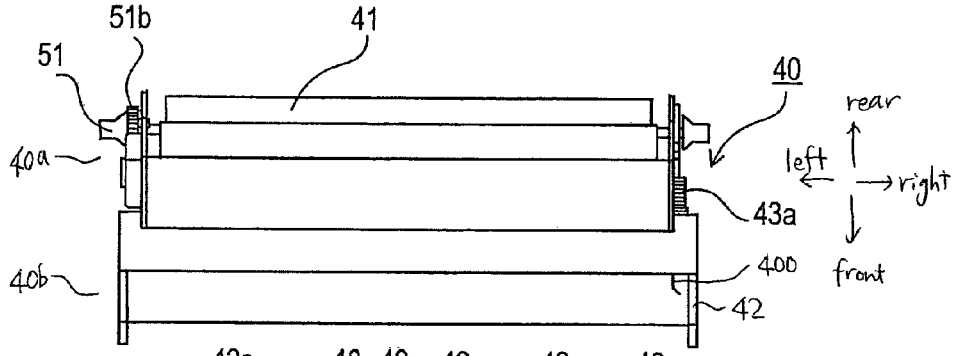
FIG. 15A is a top view of the development cartridge according to an additional aspect.
Figure 15B:
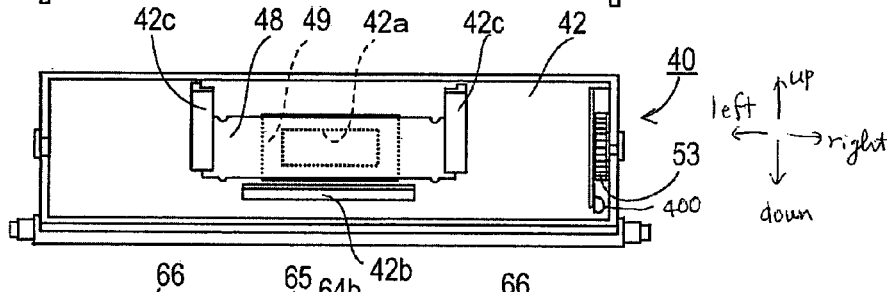
FIG. 15B is a front view of a toner-cartridge holder in the development cartridge as viewed from the toner cartridge side according to the additional aspect.
Figure 15C:
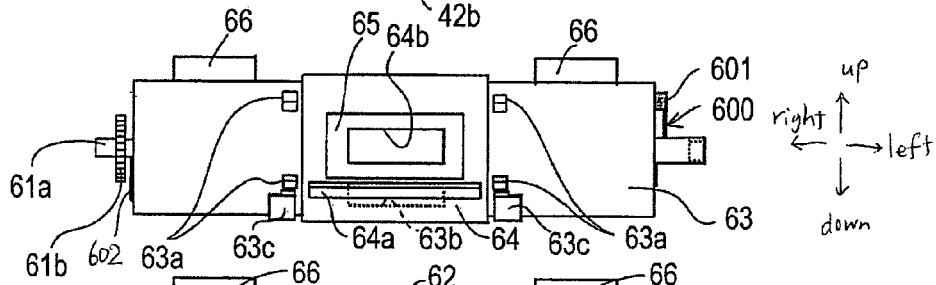
FIG. 15C is a rear view of the toner cartridge as viewed from the toner-cartridge holder side according to the additional aspect.
Figure 15D:
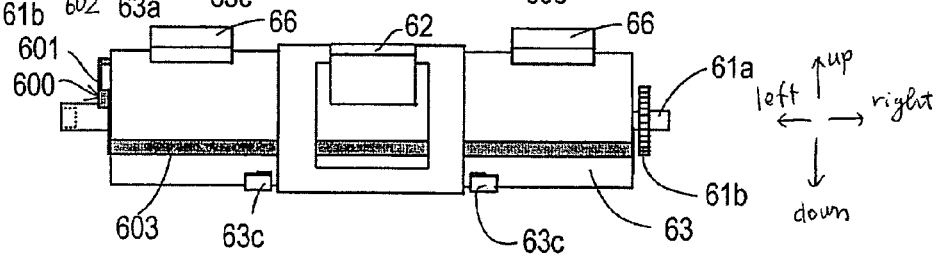
FIG. 15D illustrates the toner cartridge on its handle side according to the additional aspect.
Figure 16A:
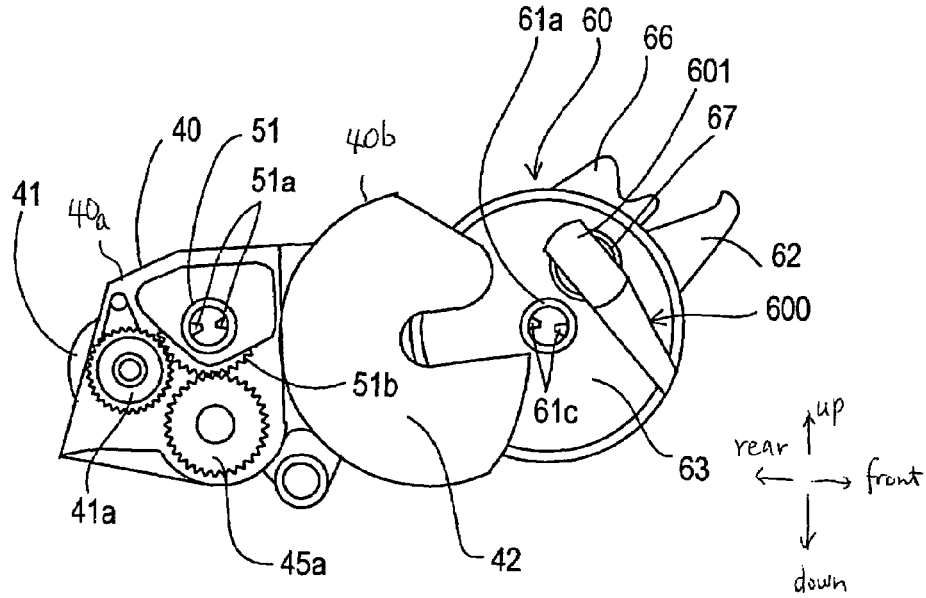
FIG. 16A is a left-side view showing the toner cartridge disconnected from the development cartridge according to the additional aspect.
Figure 16B:
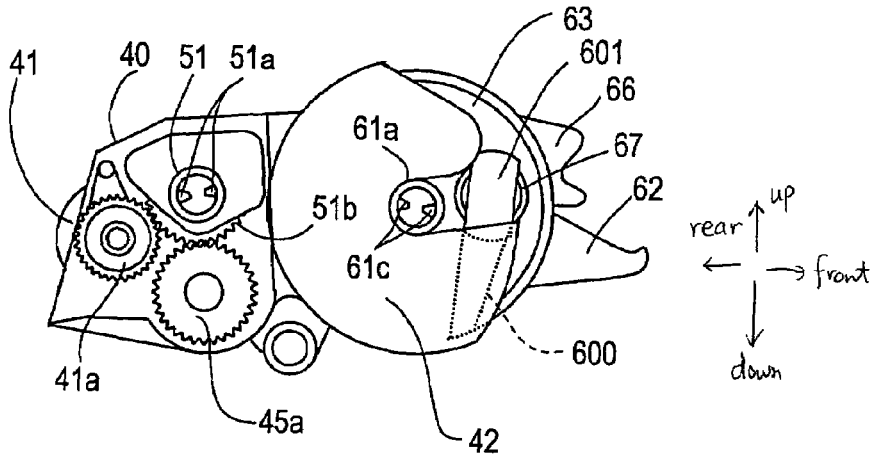
FIG. 16B is a left-side view showing the toner cartridge coupled to the development cartridge according to the additional aspect.
Figure 16C:
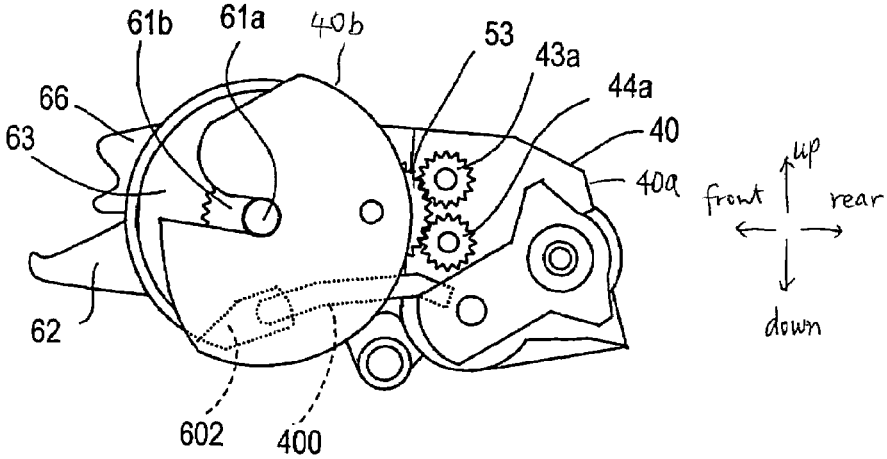
FIG. 16C is a right-side view showing the toner cartridge coupled to the development cartridge according to the additional aspect.
Figure 1:
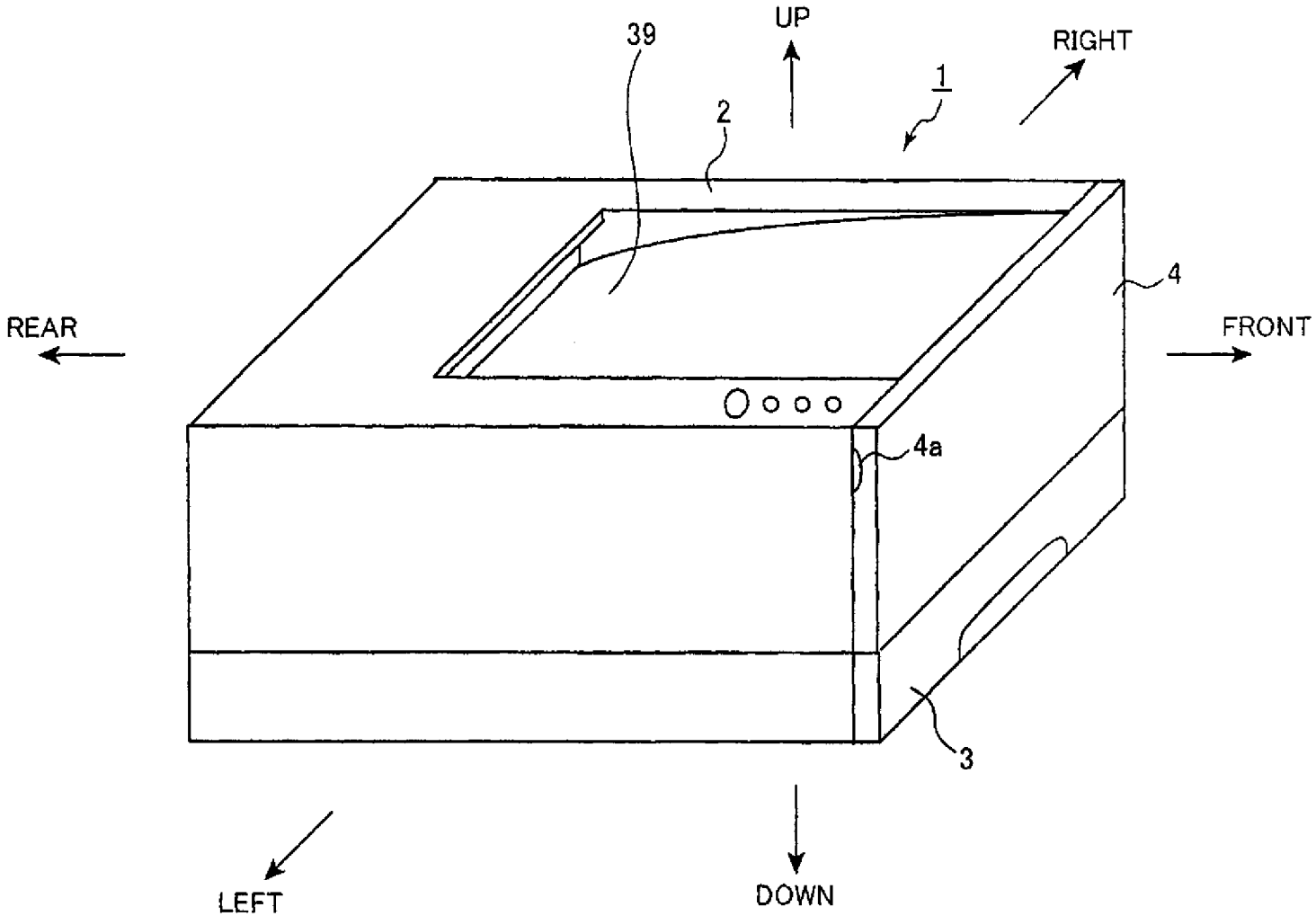
Figure 2:
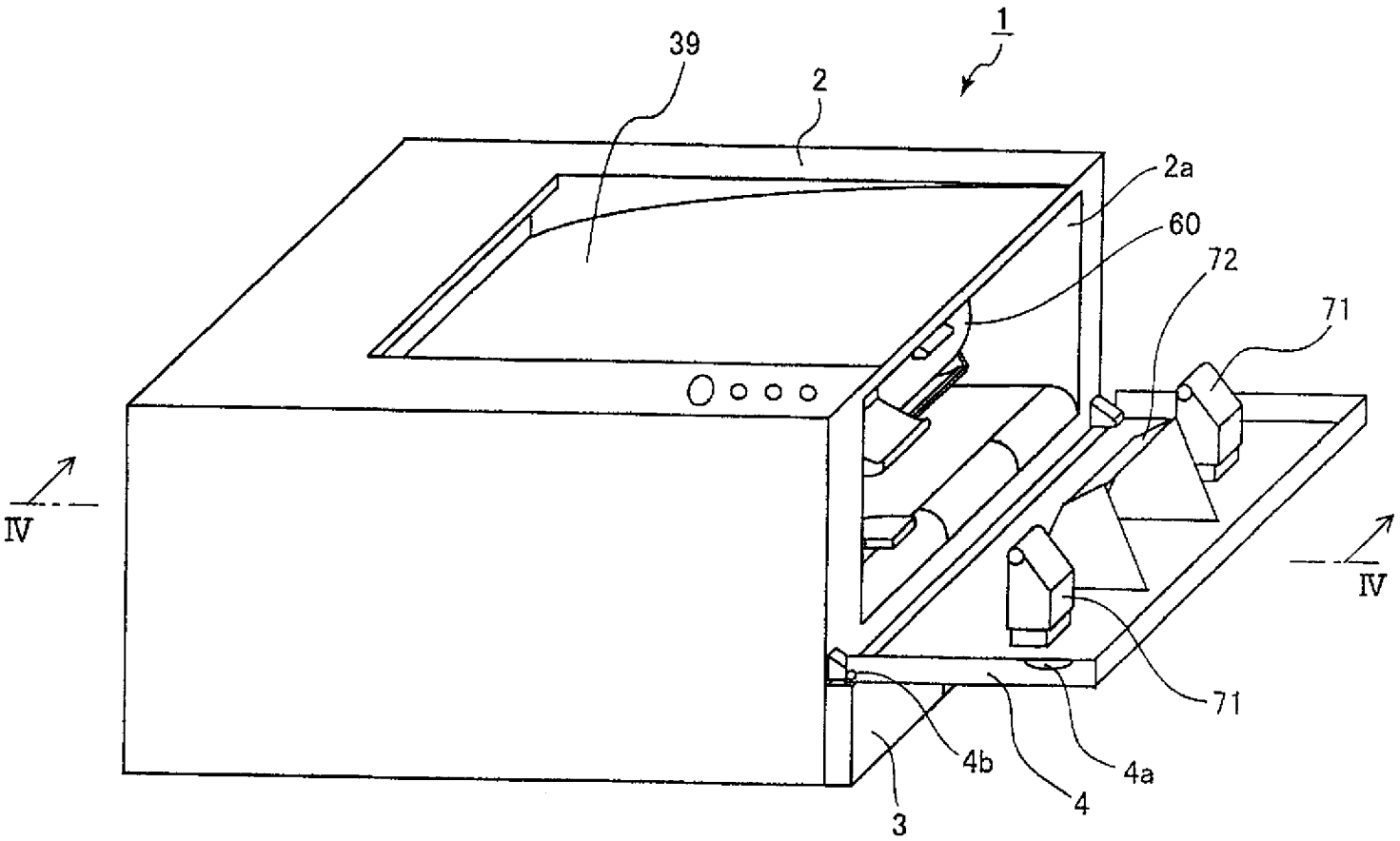
Figure 3:
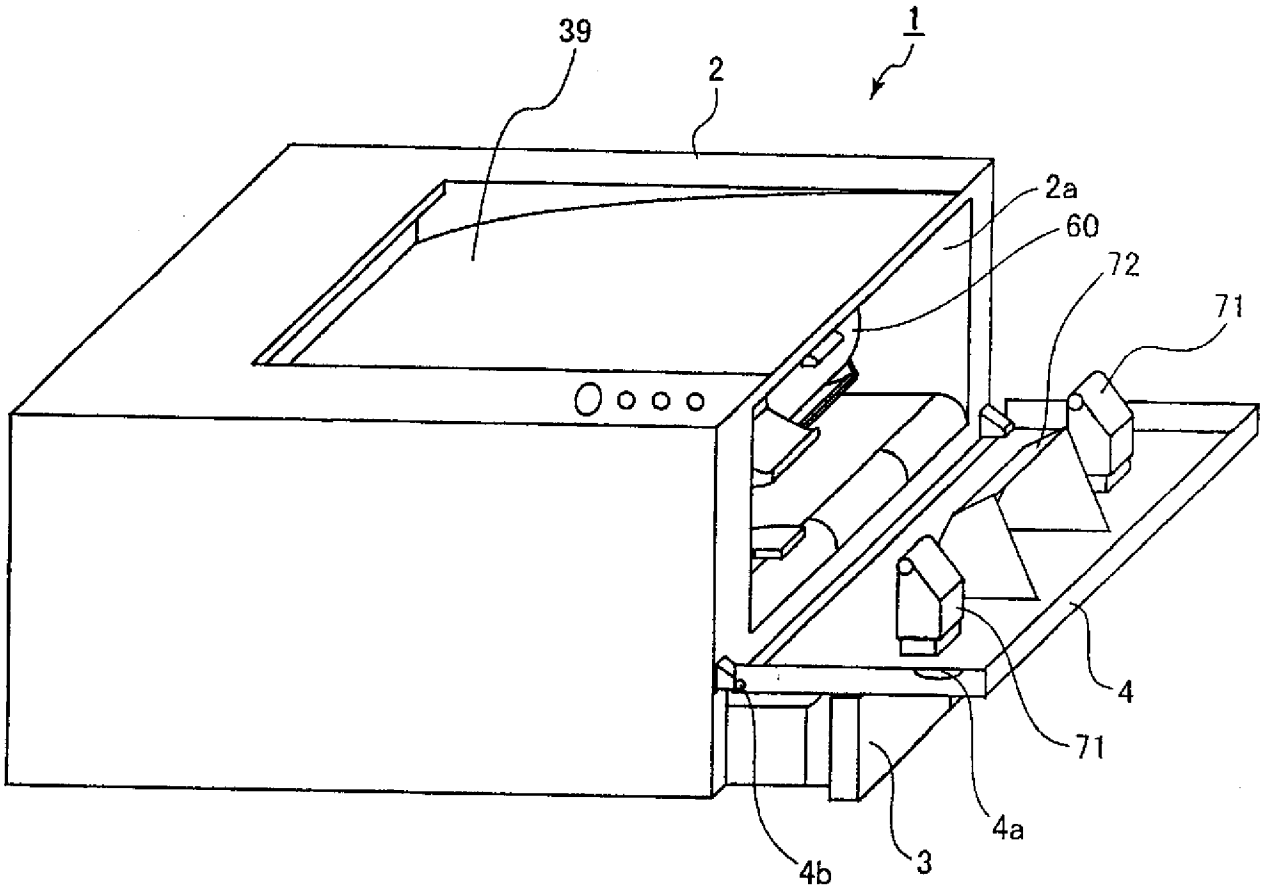
Figure 4:
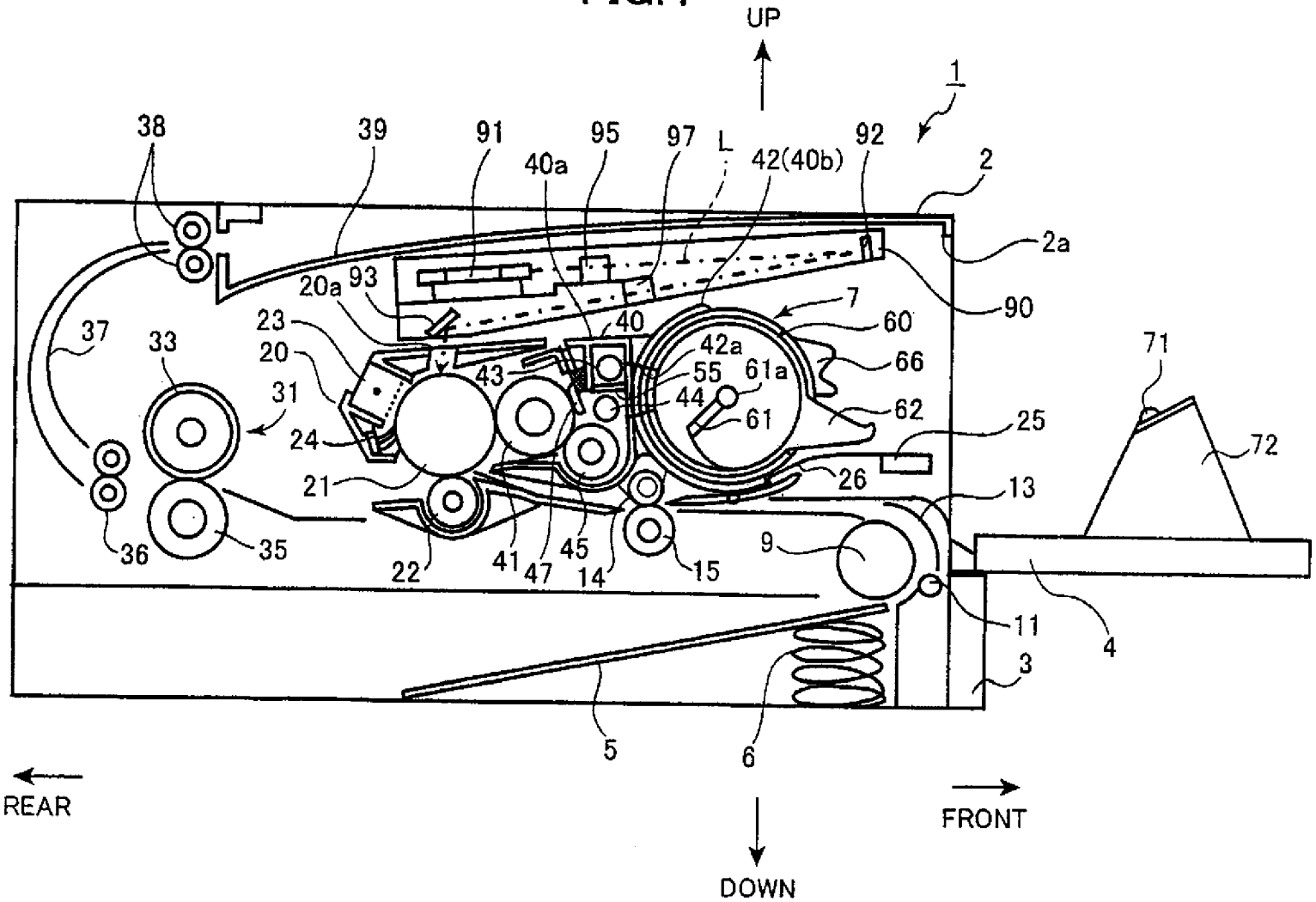
Figure 5:
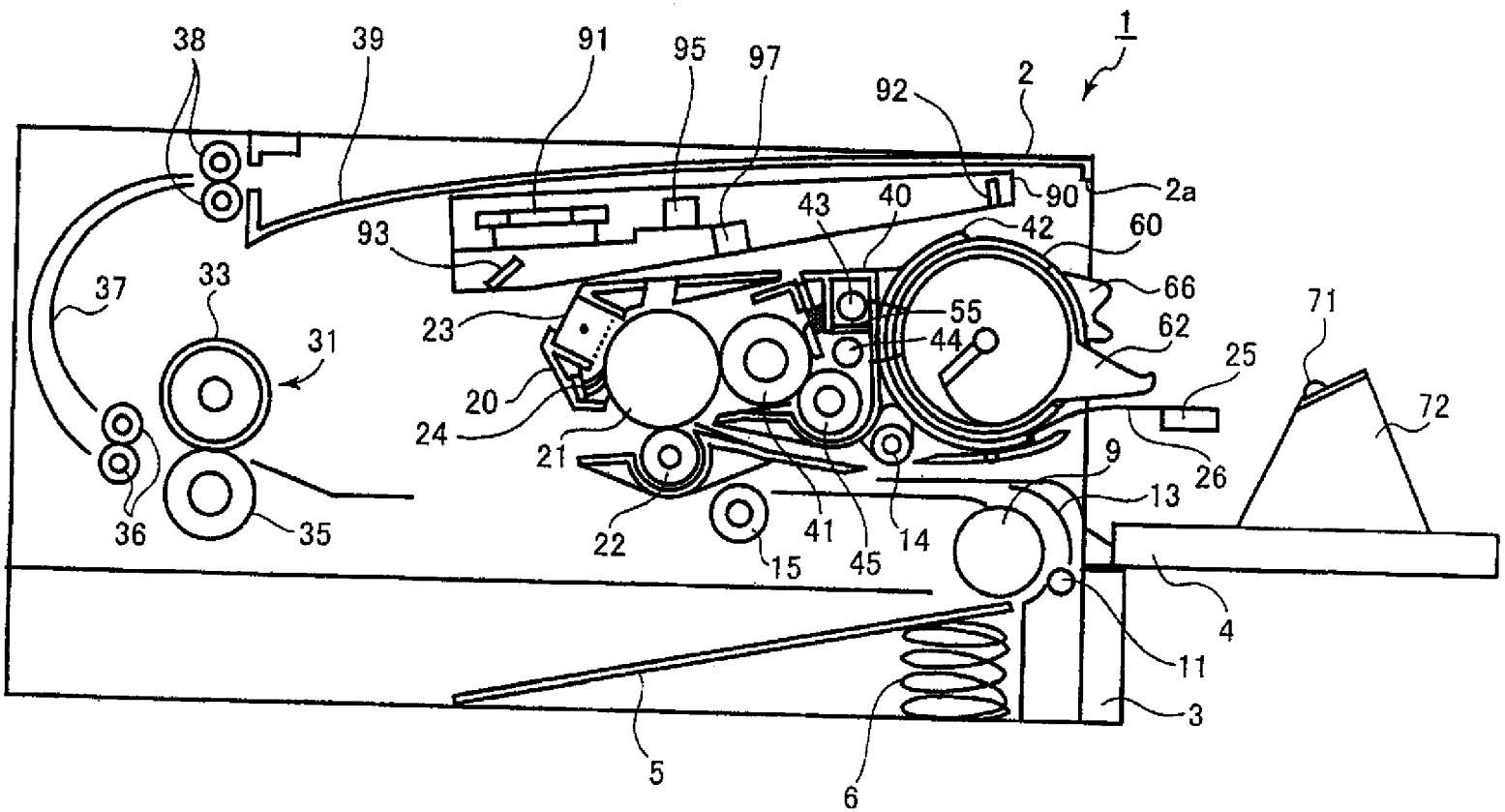
Figure 6:
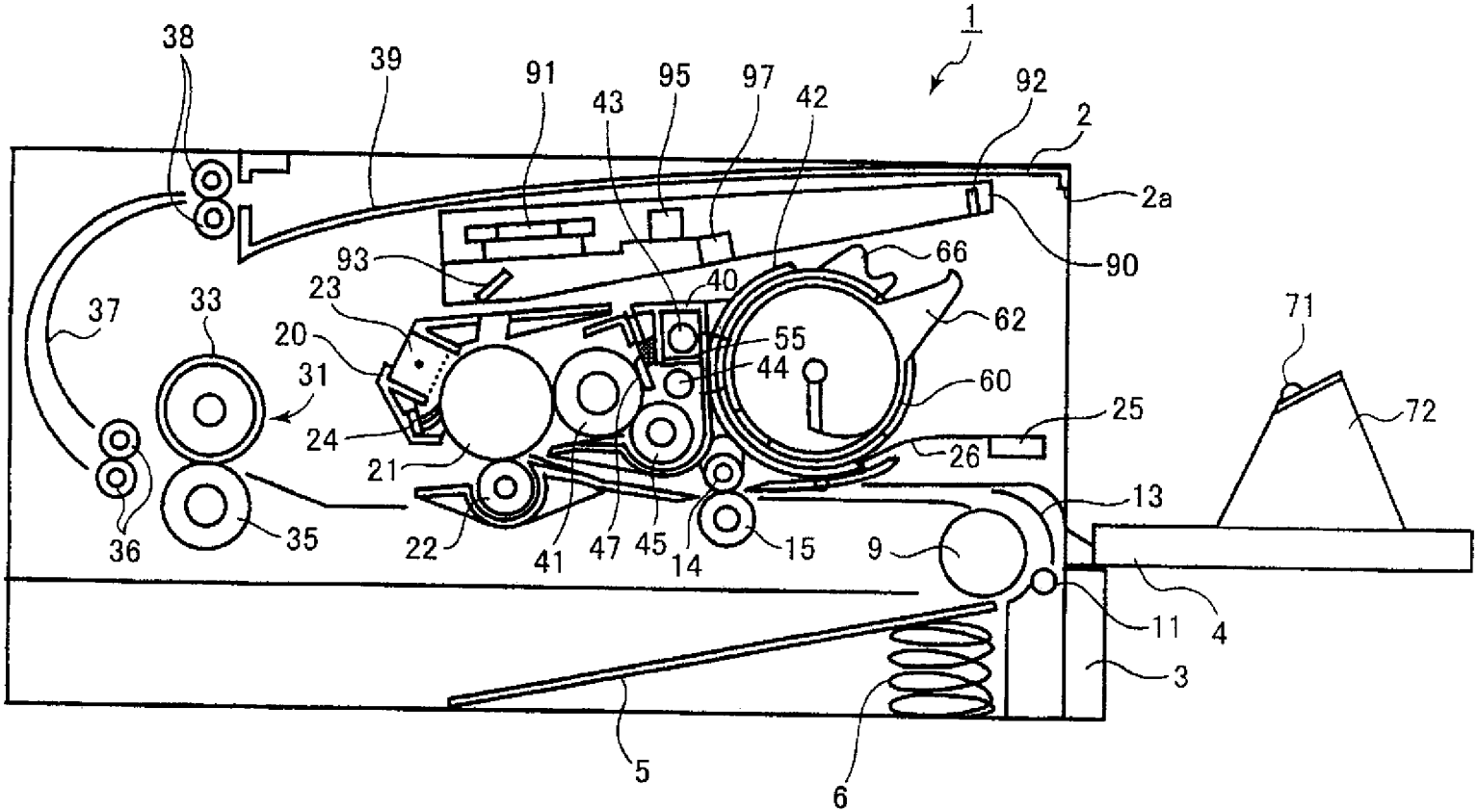
Figure 7:
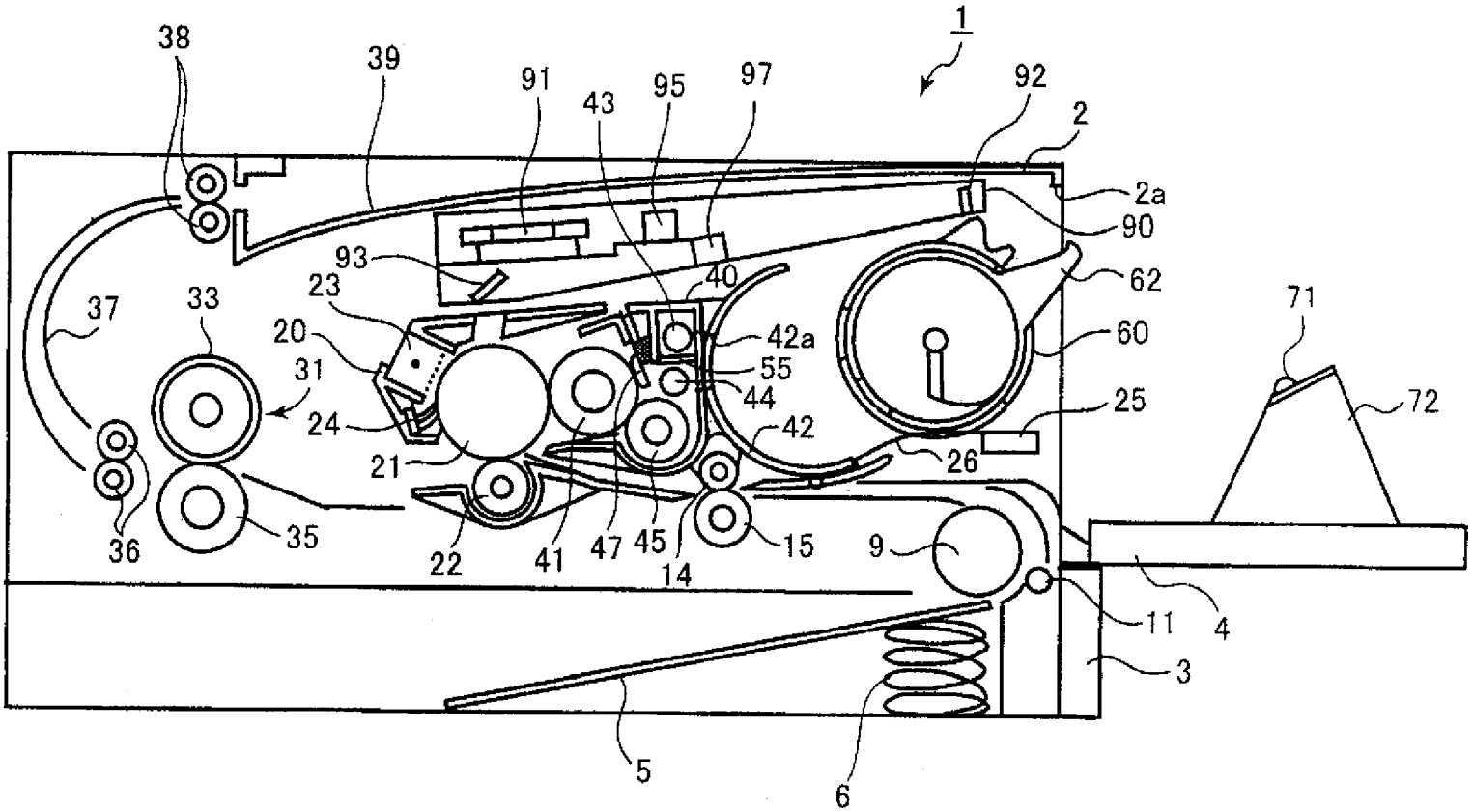
Figure 8:
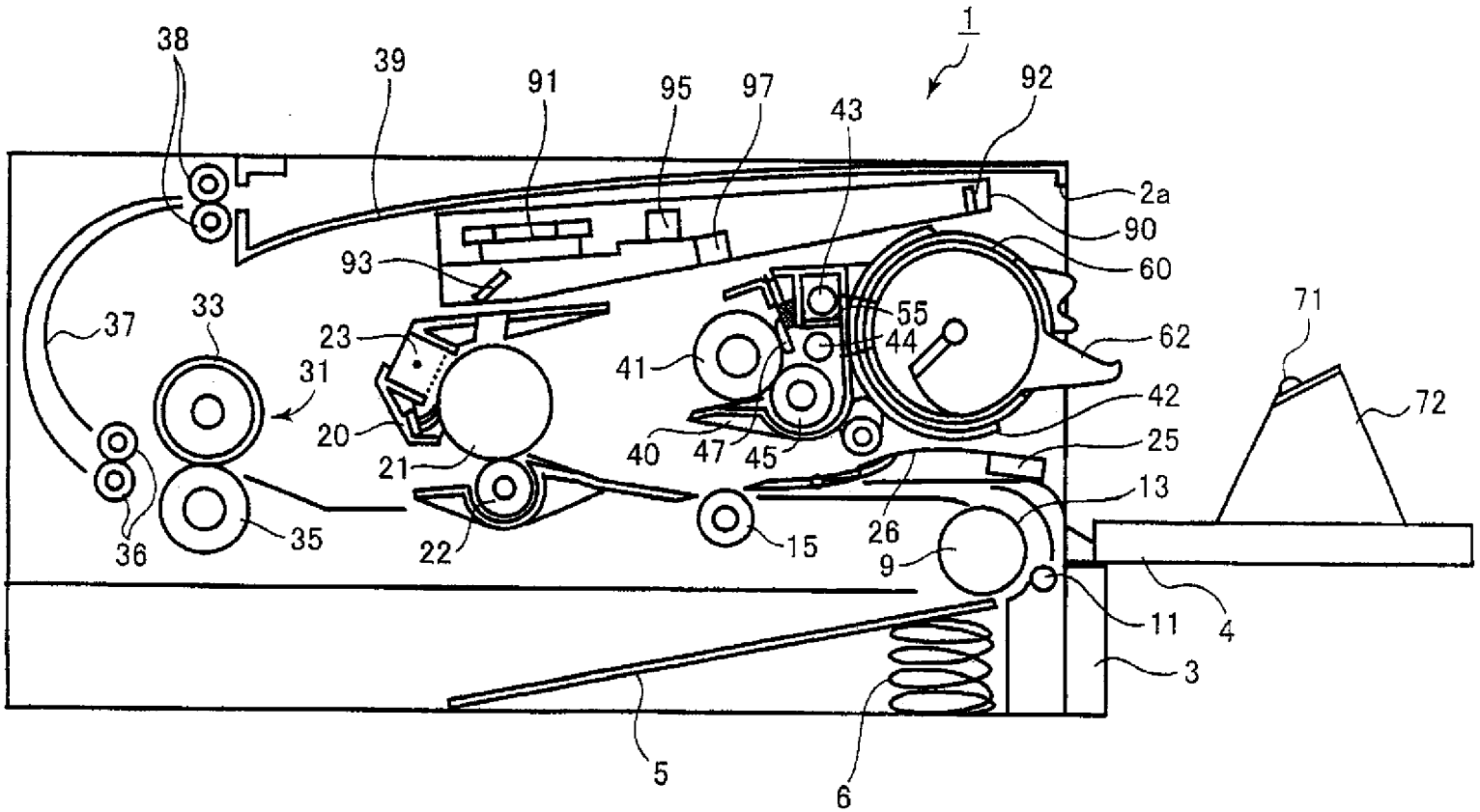
Figure 9A:
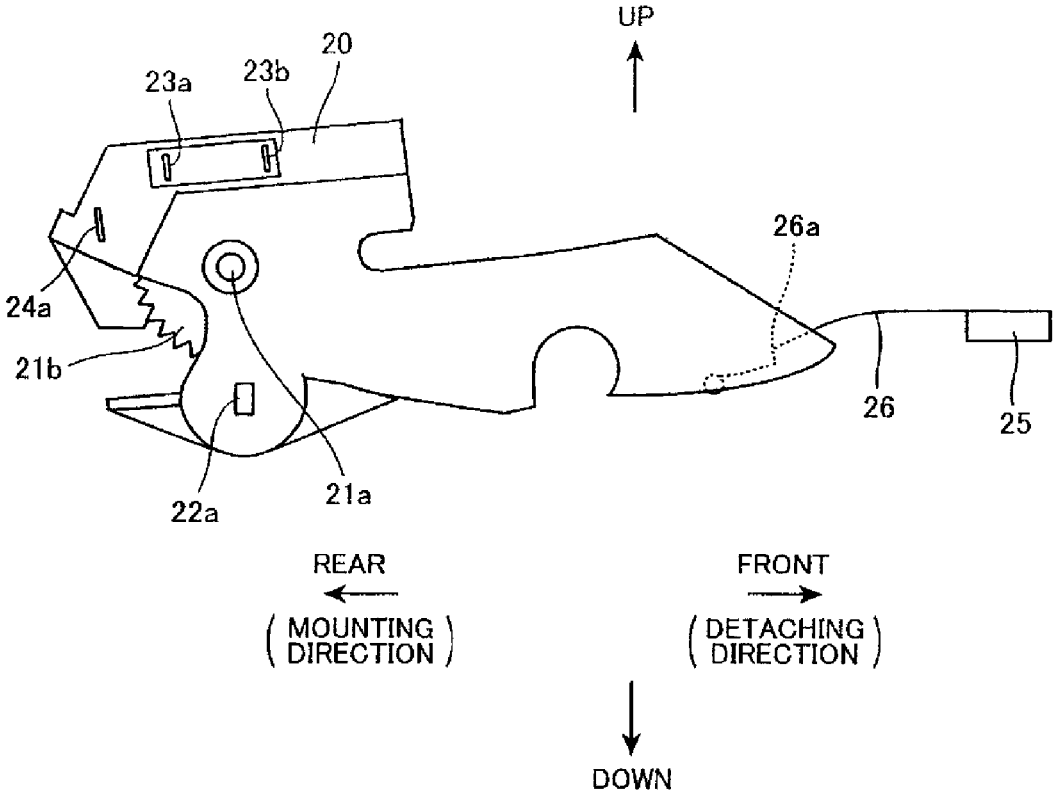
Figure 9B:
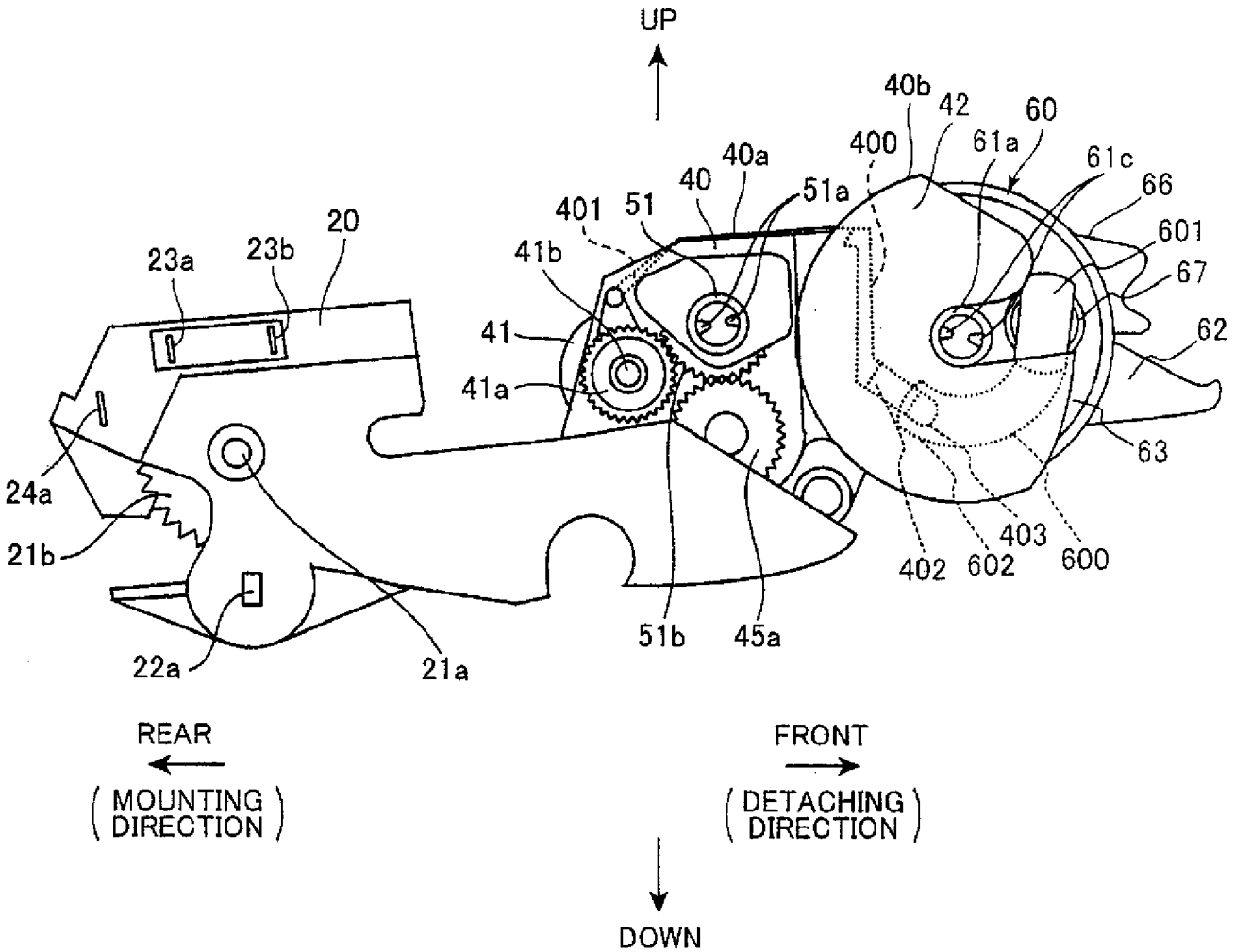
Figure 10:
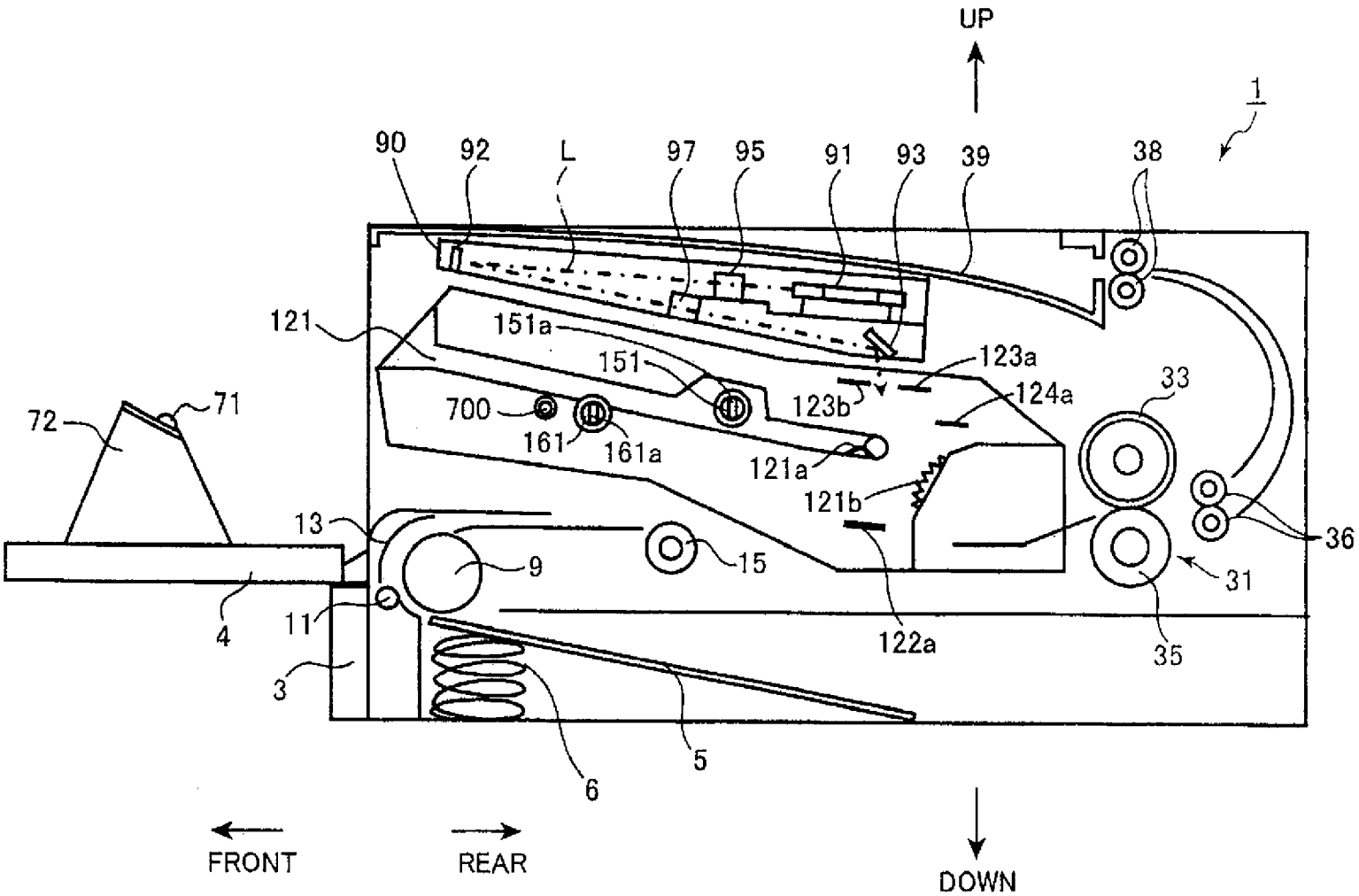
Figure 11A:
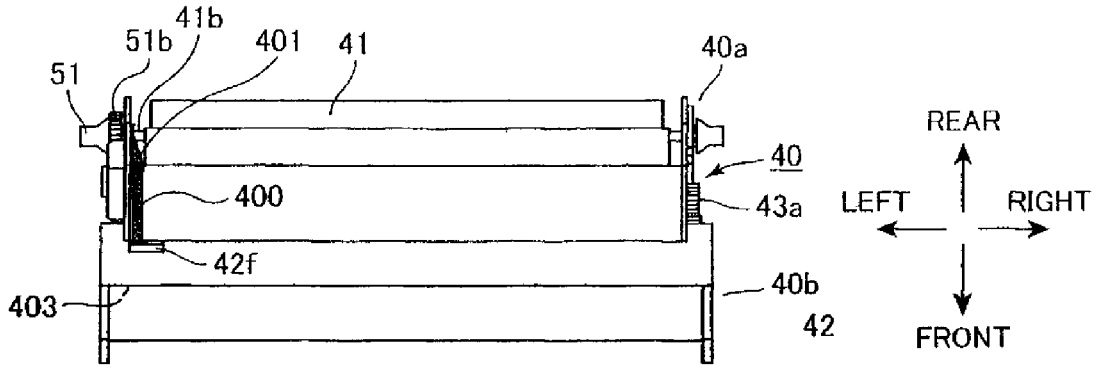
Figure 11B:
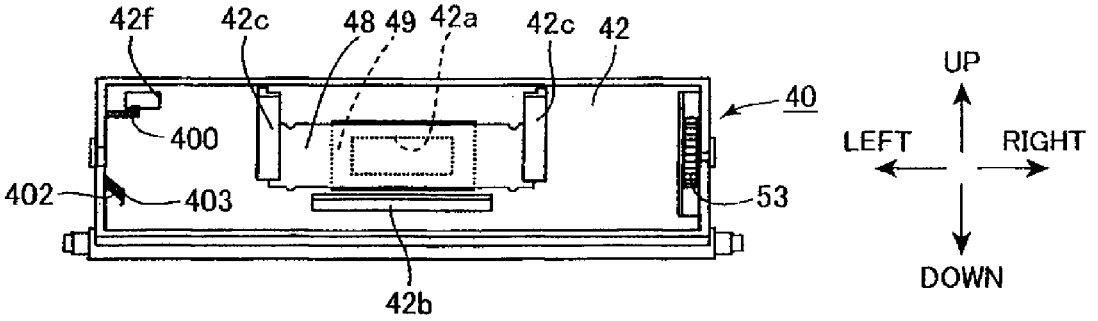
Figure 11C:
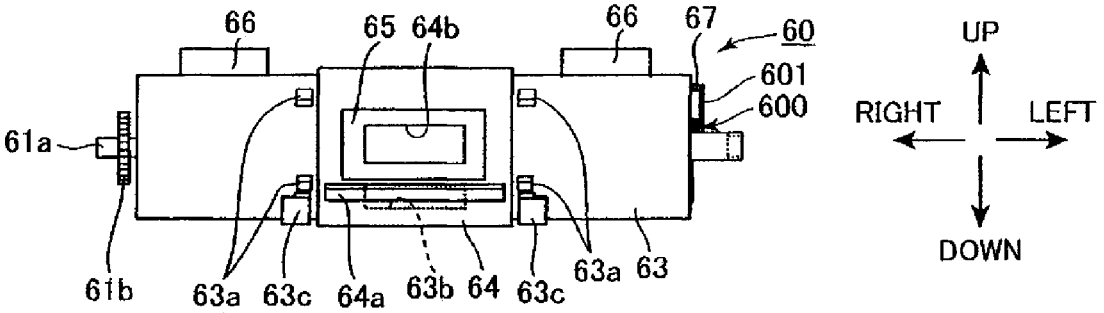
Figure 12:
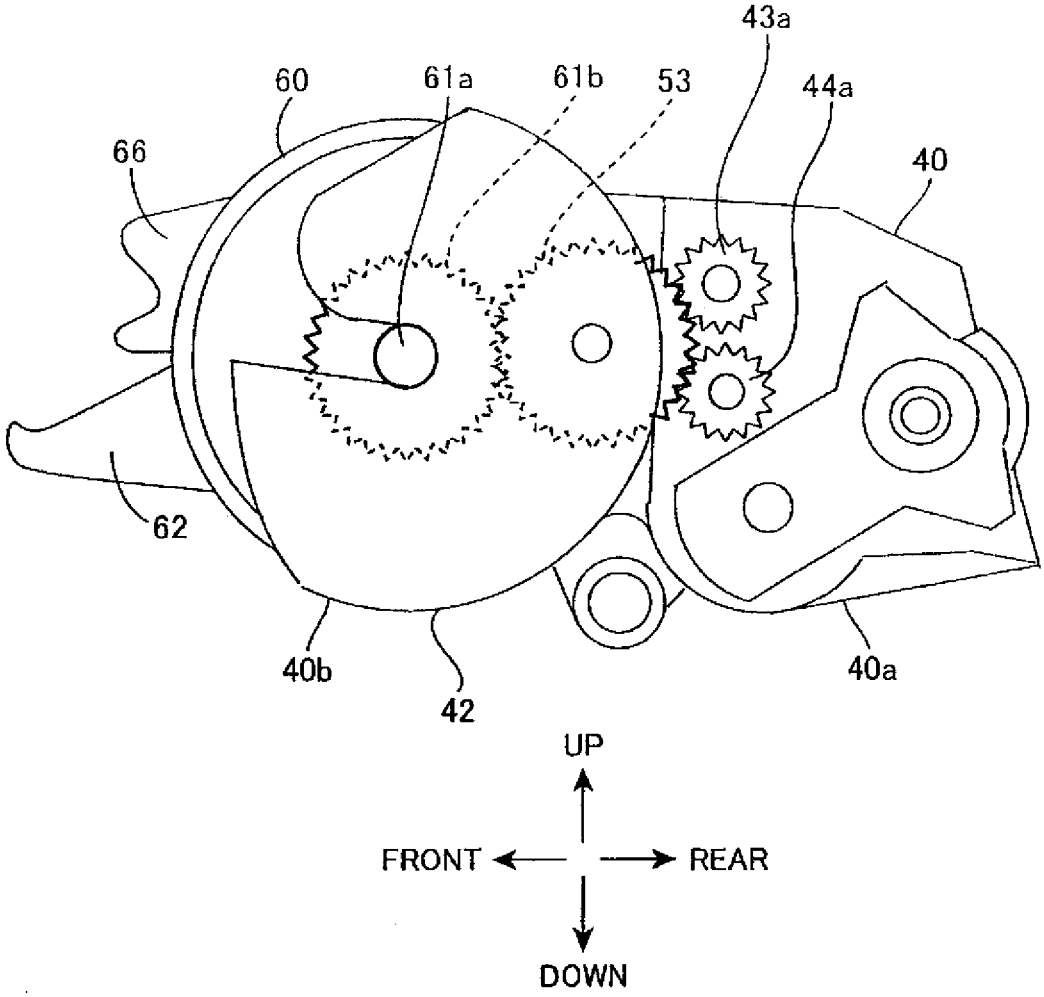
Figure 13:
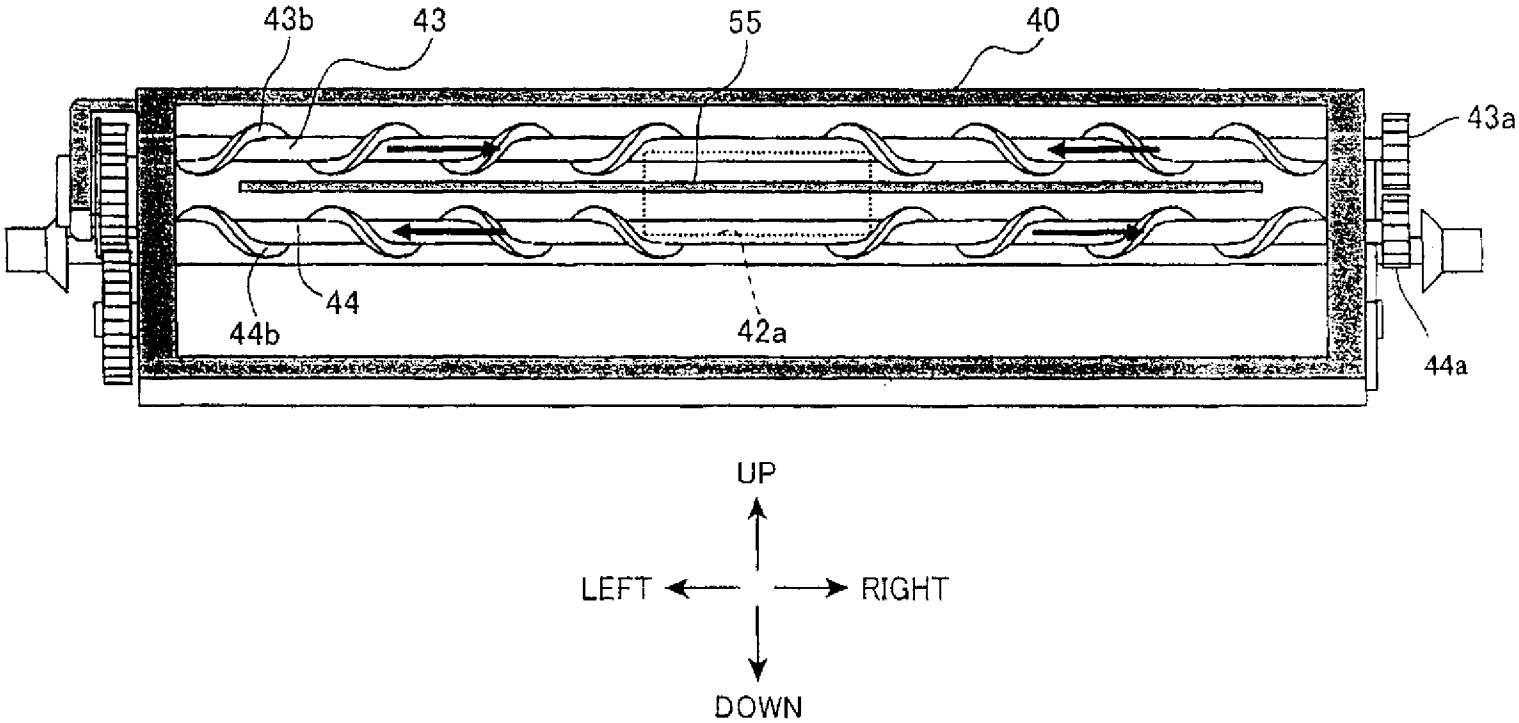
Figure 14:
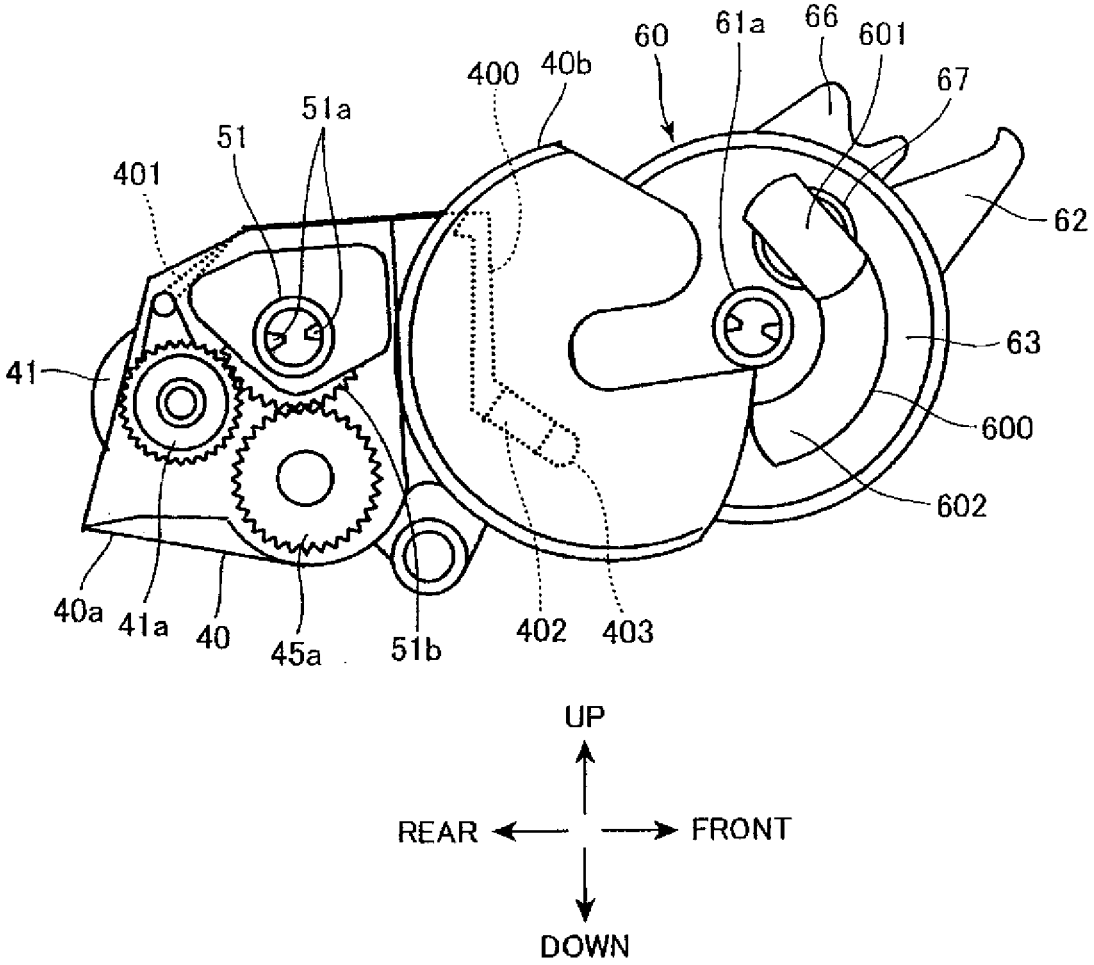
Figure 15A:
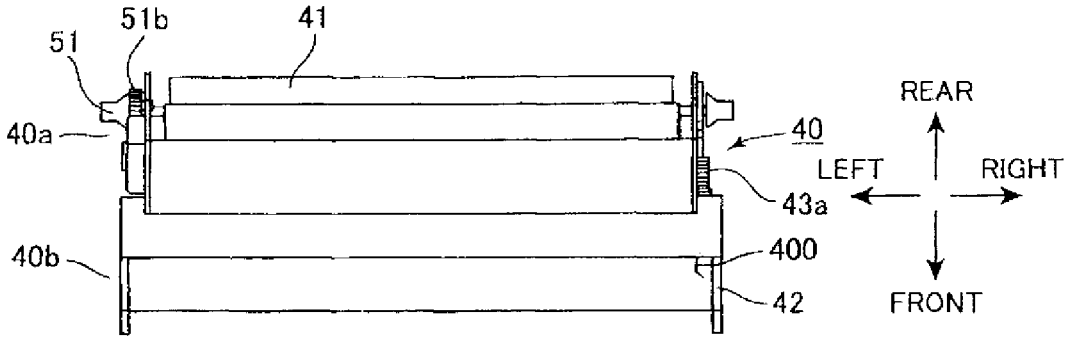
Figure 15B:
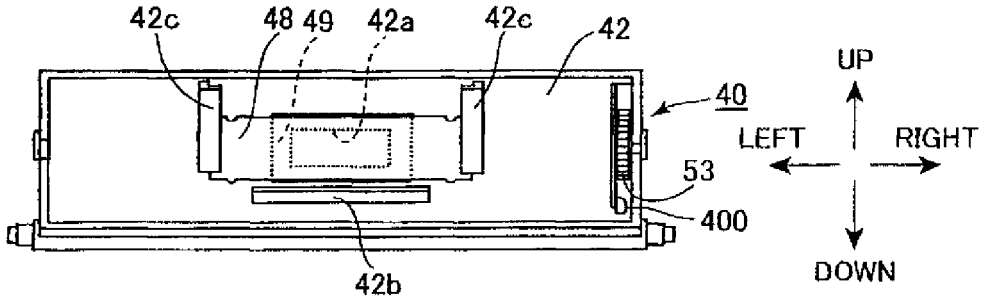
Figure 15C:
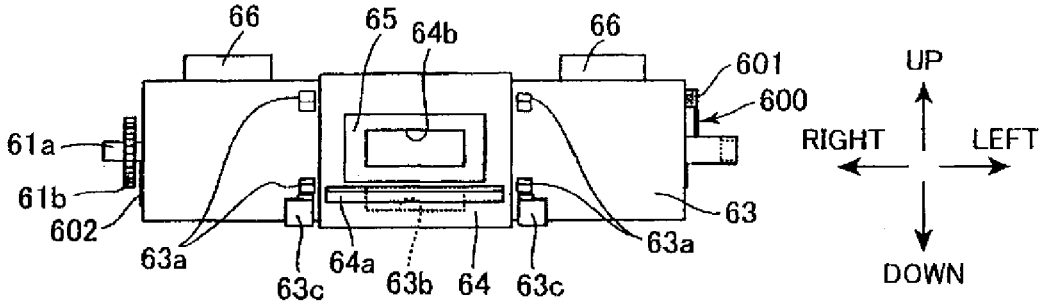
Figure 15D:
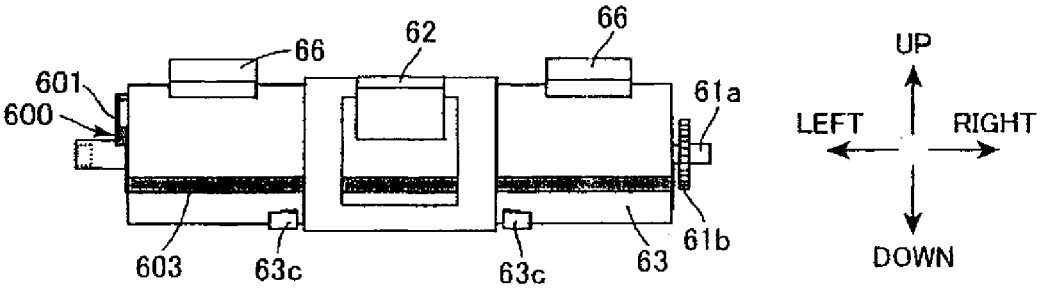
Figure 16A:
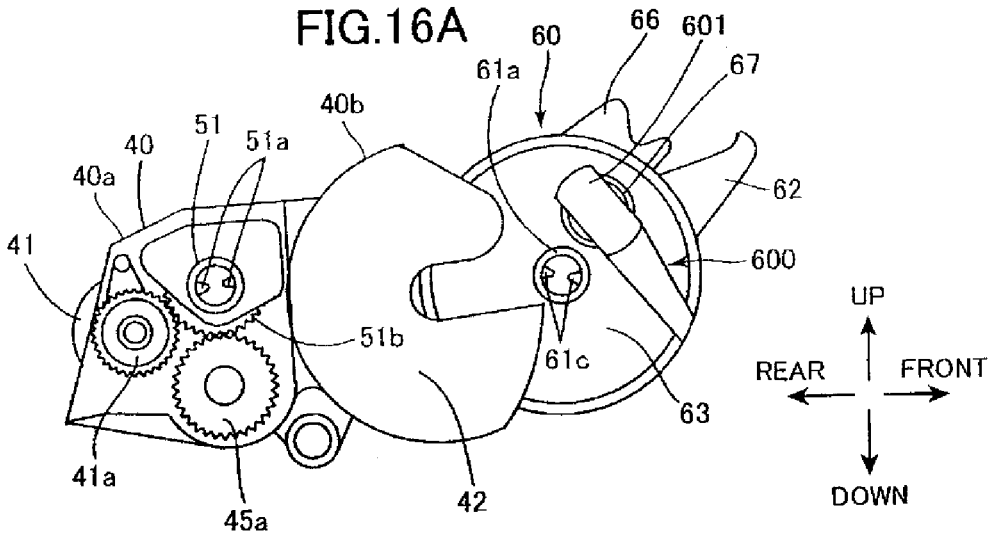
Figure 16B:
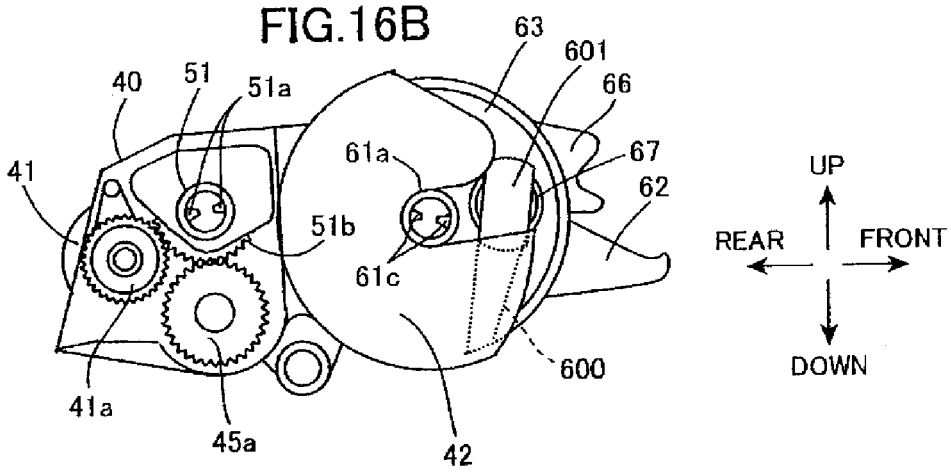
Figure 16C:
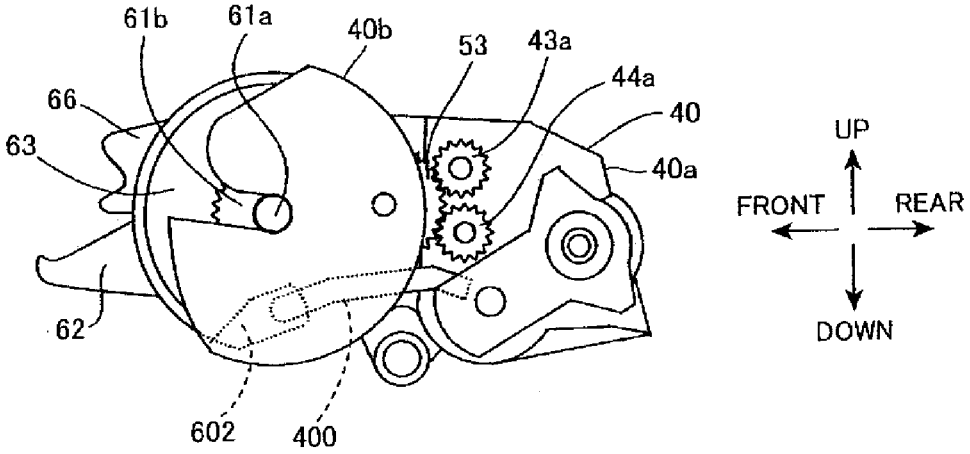

According to this additional aspect, the electrode member 400 is provided on the inner surface of the right-side end wall of the toner-cartridge holder 42 as shown in FIGS. 15A, 15B, and 16C, with its one end being connected to the rotational shaft 41*a* of the developing roller 41 and the other end being located on the inner surface of the right-side end wall of the toner-cartridge holder 42. The opposite end 602 of the electrode member 600 is provided on the outer surface of the right-side end wall of the inner cylinder 63 as shown in FIGS. 15C and 16C. The electrode member 600 has a bridging part 603 that extends between the opposite end 602 that is now on the right-side of the inner cylinder 63 and the opposite end 601 that is provided on the left-side of the inner cylinder 63 in the same manner as described in the above aspect. The bridging part 603 extends on the outer peripheral surface of the inner cylinder 63 in the axial direction thereof. In this case, the electrode members 400 and 600 are electrically connected with each other at the right side of the toner cartridge 60, while the opposite end 601 and the electrodes 22*a*, 23*a*, 23*b* and 24*a* are provided on the left side of the cartridges 60 and 20. This arrangement helps to prevent leakage more reliably. The electrode member 600 including the bridging part 603 thereof is unexposed, except the opposite end 601, when the toner cartridge 60 is set in the development cartridge 40 as shown in FIGS. 16B and 16C. Leakage can therefore be reliably prevented.

Thus, also according to this additional aspect, the opposite end 601 of the electrode member 600 is configured to receive an electric power from the electrode 700. The opposite end 602 of the electrode member 600 that is connected with the opposite end 601 is configured to contact the development cartridge 40. The opposite end 601 and the opposite end 602 are provided on opposite sides of the toner cartridge 60 in the longitudinal direction of the toner cartridge 60.

While the invention has been described in detail with reference to the above aspects thereof, it would be apparent to those skilled in the art that various changes and modifications may be made therein without departing from the spirit of the invention.

The laser printer 1 can be modified to various image forming apparatuses of electronic photographic type, such as copying apparatuses, facsimile apparatuses and color laser printers. The photosensitive drum 21 may be modified into a photoelectric belt. A non-photosensitive electrostatic latent image bearing body may be provided instead of the photosensitive drum 21. An intermediate transfer belt may be used to transfer toner images onto a recording medium.

In the above description, since the photosensitive-drum cartridge 20 and the development cartridge 40 are detachably mounted in the main body of the laser printer 1, they can be replaced by new ones when necessary. This facilitates easy maintenance of the laser printer 1. However, the photosensitive-drum cartridge 20 and the development cartridge 40 may be fixedly secured in the main body of the laser printer 1.

In the above description, the photosensitive-drum cartridge 20 and the development cartridge 40 can be disconnected from each other. Instead, they may be formed integrally with each other and may not be disconnected from each other.

What is claimed is:

1. An image forming apparatus, comprising: an electrostatic latent image bearing member having a surface on which an electrostatic latent image is formed; a toner cartridge that contains toner; a developing member that supplies the toner from the toner cartridge onto the surface of the electrostatic latent image bearing member, thereby developing the electrostatic latent image into a toner image; a transfer member that transfers the toner image from the surface of the electrostatic latent image bearing member to a recording medium; a development cartridge to which the toner cartridge is removably coupled and which incorporates at least the developing member; a development contact which is provided on the toner cartridge and which is configured to receive a voltage to be applied to the developing member; and electrical connection units which are provided on the toner cartridge and the development cartridge, respectively, and which apply the voltage from the development contact to the developing member when the toner cartridge and the development cartridge are coupled to each other.

2. The image forming apparatus according to claim 1, wherein the development cartridge comprises a toner-cartridge-holding portion that holds the toner cartridge, while preventing the electrical connection units from being exposed.

3. The image forming apparatus according to claim 2, wherein the toner cartridge comprises: an outlet port through which toner is supplied to the development cartridge from the toner cartridge when the toner cartridge is held by the toner-cartridge-holding portion; and an outlet port opening/closing unit that opens/closes the outlet port, and wherein the electrical connection units of the toner cartridge and the development cartridge are configured to be connected with each other when the outlet port opening/closing unit opens the outlet port and to be disconnected from each other when the outlet port opening/closing unit closes the outlet port.

4. The image forming apparatus according to claim 3, wherein the toner cartridge comprises a movable unit that moves when operated, wherein the outlet port opening/closing unit opens/closes the outlet port in association with the movement of the movable unit, and wherein when the movable unit moves to cause the outlet pod opening/closing unit to open the outlet port, the movable unit causes the electrical connection unit on the toner cartridge to contact with the electrical connection unit on the development cartridge.

5. The image forming apparatus according to claim 1, further comprising: a charging member tat electrically charges the electrostatic latent image bearing member; and a charging contact, to which a voltage to be applied to the charging member is applied, the charging contact and the development contact being arranged on the same widthwise side of a recording medium.

6. A toner cartridge which is removably attachable to a development cartridge that includes a developing member, the toner cartridge comprising: a casing defining a toner containing portion containing a toner therein; and a development contact which is provided on the casing and which is configured to be electrically connectable with the developing member of the development cartridge.

7. The toner cartridge according to claim 6, wherein the development contact is electrically connected to the developing member when the toner cartridge is attached to the development cartridge.

8. The toner cartridge according to claim 6, wherein the development contact comprises: a receiving part configured to receive an electric power from an image forming apparatus; and a supplying part that is connected with the receiving part.

9. The toner cartridge according to claim 8, wherein the receiving part and the supplying part are provided on opposite sides of the toner cartridge in a longitudinal direction of the toner cartridge.

10. The toner cartridge according to claim 8, wherein the supplying part is configured to contact the development cartridge, the supplying part being provided at a different area where the receiving part is provided.

11. The toner cartridge according to claim 8, wherein the receiving part and the supplying part are located in a circular arc.

12. The toner cartridge according to claim 6, wherein the casing is formed with an outlet port in communication with the toner containing portion, the toner contained in the toner containing portion being configured to be supplied outside through the outlet port, and further comprising an outlet port opening/closing unit that opens and closes the outlet port, wherein the development contact is electrically connected to the development cartridge while the toner cartridge is attached to the development cartridge and the outlet port opening/closing unit opens the outlet port.

13. The toner cartridge according to claim 12, wherein the development contact is electrically disconnected from the development cartridge while the toner cartridge is detached from the development cartridge and the outlet port opening/closing unit closes the outlet port.

14. The toner cartridge according to claim 12, further comprising an operation unit that moves the casing relative to the development cartridge when operated, the outlet port opening/closing unit opening and closing the outlet port in association with the movement of the casing.

15. The toner cartridge according to claim 14, wherein when the casing moves to cause the outlet port opening/closing unit to open the outlet port, the development contact is located at a position where the development contact is electrically connected to the developing member.

16. The toner cartridge according to claim 14, wherein the casing moves in a circular arc path, the development contact moving in the circular arc path together with the casing.

17. The toner cartridge according to claim 16, wherein the development contact extends along the circular arc path.

18. The toner cartridge according to claim 16, wherein the development contact is located in the circular arc path.

19. The toner cartridge according to claim 18, wherein the development contact comprises: a receiving part configured to receive an electric power from an image forming apparatus; and a supplying part that is connected with the receiving part, the receiving part and the supplying part are located in the circular arc path.

20. The toner cartridge according to claim 16, further comprising: an agitating member that rotates about a rotation axis, the agitating member being supported by the casing; wherein an axis of the circular arc path is the rotation axis.

21. The toner cartridge according to claim 20, further comprising: a drive-force input unit to which a drive force is inputted; and a drive-force output unit that is configured to output the drive force.

22. The toner cartridge according to claim 21, wherein the agitating member is rotatable by the drive force.

23. The toner cartridge according to claim 6, wherein the development contact protrudes outwardly from the casing, and wherein when the toner cartridge coupled to the development cartridge is mounted in an image forming apparatus, the development contact protrudes toward a voltage applying unit that is provided in the image forming apparatus.

24. The toner cartridge according to claim 6, wherein the casing is formed with an opening, on which a lid member is removably provided, the development contact being provided on an outer surface of the lid member.

25. The toner cartridge according to claim 6, further comprising: a drive-force input unit to which a drive force is inputted; and a drive-force output unit that is configured to output the drive force.

26. A development cartridge comprising: a toner-cartridge-holding portion that removably holds a toner cartridge that contains toner therein; a developing member that supplies toner from the toner cartridge to a surface of an electrostatic latent image bearing member, on which an electrostatic latent image is formed, thereby developing the electrostatic latent image into a toner image; and an electrical connection unit which is provided on the toner-cartridge-holding portion, the electrical connection unit being electrically connected to the toner cartridge to apply a voltage to the developing member when the toner cartridge is mounted in the toner-cartridge-holding portion.

27. The development cartridge according to claim 26, wherein the toner-cartridge-holding portion holds the toner cartridge, while preventing the electrical connection unit from being exposed.

* * * * *

UNITED STATES PATENT AND TRADEMARK OFFICE

CERTIFICATE OF CORRECTION

PATENT NO. : 7,561,817 B2
APPLICATION NO. : 11/363163
DATED : July 14, 2009
INVENTOR(S) : Sato It is certified that error appears in the above-identified patent and that said Letters Patent is hereby corrected as shown below:

The title page, showing an illustrative figure, should be deleted and substitute therefor the attached title page.

Delete drawing sheets 1-17 and substitute therefor the drawing sheets, consisting of figures 1-16C as shown on the attached pages.

Signed and Sealed this

Twenty-fourth Day of November, 2009

David J. Kappos

David J. Kappos
*Director of the United States Patent and Trademark Office*

(12) United States Patent
Sato

(10) Patent No.: US 7,561,817 B2
(45) Date of Patent: Jul. 14, 2009

(54) TONER CARTRIDGES, DEVELOPMENT CARTRIDGES, AND IMAGE FORMING APPARATUS INCLUDING SUCH CARTRIDGES

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 356 days.

(21) Appl. No.: 11/363,163

(22) Filed: Feb. 28, 2006

(65) Prior Publication Data

US 2006/0193652 A1 Aug. 31, 2006

(30) Foreign Application Priority Data

Feb. 28, 2005 (JP) ..... 2005-053069

(51) Int. Cl.
*G03G 15/00* (2006.01)
*G03G 15/08* (2006.01)

(52) U.S. Cl. ..... 399/90; 399/119

(58) Field of Classification Search ..... 399/90, 399/119, 262
See application file for complete search history.

(56) References Cited

U.S. PATENT DOCUMENTS 4,839,691 A * 6/1989 Tagawa et al. ..... 399/119
5,523,832 A 6/1996 Hamamichi et al.
5,541,714 A 7/1996 Watanabe et al.
5,608,501 A 3/1997 Makino
5,742,882 A 4/1998 Lee
5,867,756 A 2/1999 Suzuki et al.
6,127,083 A 10/2000 Nomura et al.
6,169,865 B1 1/2001 Miyabe et al.
6,351,618 B1 2/2002 Pollocks, Jr.
6,501,933 B2 12/2002 Ishii
6,823,155 B2 11/2004 Tsuda et al.
7,252,918 B2 8/2007 Nakamura et al.
7,272,336 B1 * 9/2007 Dawson et al. ..... 399/90
7,321,739 B1 * 1/2008 Dawson et al. ..... 399/90
2001/0041079 A1 11/2001 Michlin et al.

(Continued)

FOREIGN PATENT DOCUMENTS

CN 1167280 A 12/1997

(Continued)

OTHER PUBLICATIONS

European Patent Office, Extended European Search Report for European Patent Application No. 06003853.6-1240, dated Jan. 18, 2008.

(Continued)

*Primary Examiner* William J Royer
(74) *Attorney, Agent, or Firm*—Baker Botts L.L.P.

(57) ABSTRACT

An image forming apparatus includes: an electrostatic latent image bearing member; a toner cartridge; a developing member; a transfer member; a development cartridge; a development contact; and electrical connection units. The toner cartridge is removably coupled to the development cartridge. The development cartridge incorporates at least the developing member. The development contact is provided on the toner cartridge and is configured to receive a voltage to be applied to the developing member. The electrical connection units are provided on the toner cartridge and the development cartridge, respectively, and apply the voltage from the development contact to the developing member when the toner cartridge and the development cartridge are coupled to each other.

27 Claims, 17 Drawing Sheets

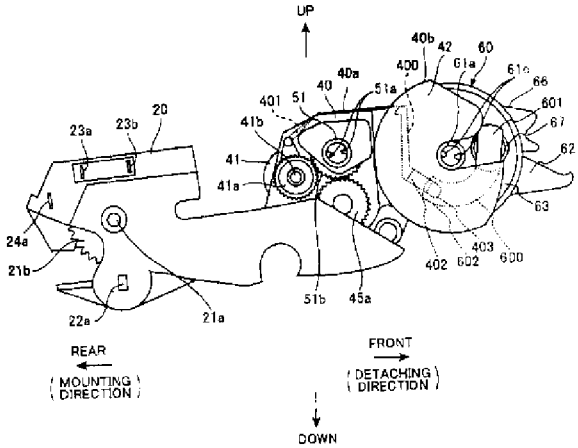

UP
RIGHT
FRONT
DOWN
LEFT
REAR
1
2
3
4
4a
39